US012631075B1

(12) United States Patent
Selvam et al.

(10) Patent No.: US 12,631,075 B1
(45) Date of Patent: May 19, 2026

(54) RETENTION SYSTEM FOR RETAINING DECK BUSHING OF DRILLING MACHINE

(71) Applicant: Caterpillar Global Mining Equipment LLC., Denison, TX (US)

(72) Inventors: Sudhagar Selvam, Chennai (IN); Yagneshwar Natarajan, Chennai (IN); Roberto Garcia, Sherman (IN); Pandidurai P, Chennai (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 19/050,206

(22) Filed: Feb. 11, 2025

(51) Int. Cl.
*E21B 19/15* (2006.01)

(52) U.S. Cl.
CPC ..... *E21B 19/155* (2013.01)

(58) Field of Classification Search
CPC ..... E21B 19/146; E21B 19/20; E21B 19/18; E21B 7/02; E21B 19/15; E21B 7/025; E21B 12/00; E21B 19/16; E21B 19/161; E21B 10/00; E21B 17/00; E21B 7/021
See application file for complete search history.

(56) References Cited

U.S. PATENT DOCUMENTS 2,976,943 A * 3/1961 Curtis ..... E21B 19/16 173/164
3,336,991 A * 8/1967 Klem ..... E21B 19/146 175/85
3,750,769 A * 8/1973 Young ..... E21B 7/28 175/85
3,976,149 A 8/1976 Granholm
3,977,480 A * 8/1976 Hilding ..... E21B 19/18 175/203
4,974,686 A * 12/1990 Hisey ..... E21B 19/20 173/164
7,886,846 B2 * 2/2011 Pires ..... E21B 19/146 175/85
8,360,237 B2 * 1/2013 Weaver ..... E21B 10/00 206/349
10,246,953 B2 4/2019 Gonzalez
10,597,956 B2 3/2020 Gaska et al.
11,261,677 B2 3/2022 Hellman
2015/0315859 A1 11/2015 Strydom
(Continued)

FOREIGN PATENT DOCUMENTS

KR 20160022568 3/2016
WO 2009156575 12/2009
(Continued)

*Primary Examiner* — Gregory W Adams

(57) ABSTRACT

A retention system includes a pipe rack rotatable between a first pipe rack position and a second pipe rack position, a retention arm assembly coupled with the pipe rack, and a pipe positioner system. The retention arm assembly is rotatable relative to the pipe rack between a first arm position and a second arm position. When the pipe rack is in the first pipe rack position and the retention arm assembly is in the first arm position, the retention arm assembly is disengaged from a deck bushing of a drilling machine. When the pipe rack is in the second pipe rack position and the retention arm assembly is in the second arm position, the retention arm assembly is engaged to retain the deck bushing in a raised state. The pipe positioner system contacts the drill string to guide and center a movement of the drill string along a vertical axis.

17 Claims, 21 Drawing Sheets

(56) References Cited

U.S. PATENT DOCUMENTS

| | | | | |
|---|---|---|---|---|
| 2016/0290072 | A1 | 10/2016 | Scott et al. | |
| 2017/0234085 | A1* | 8/2017 | Gaska | E21B 19/163 166/77.51 |
| 2018/0291696 | A1 | 10/2018 | Amerson et al. | |

FOREIGN PATENT DOCUMENTS

| | | |
|---|---|---|
| WO | 2023028033 | 3/2023 |
| WO | 2024013549 | 1/2024 |

* cited by examiner

RETENTION SYSTEM FOR RETAINING DECK BUSHING OF DRILLING MACHINE

TECHNICAL FIELD

The present disclosure relates to a drilling machine, and more particularly, to a retention system for retaining a deck bushing of the drilling machine and a method for retaining the deck bushing of the drilling machine.

BACKGROUND

A drilling machine includes a drill string having a work tool for performing drilling operations at a worksite. The drill string includes one or more connected drill pipes, cross-over adaptors, and the work tool which is connected to a bottom of a formation. The work tool may include a rotary drill bit or a down-the-hole drill bit. The drill pipe is connected to a rotary head of the drilling machine for performing a drilling operation. Further, a drill pipe adaptor many a times connects the work tool with the drill pipe.

The drilling machine includes a deck bushing that provides horizontal stabilization to the drill string as the drill string passes through a deck of the drilling machine. The deck bushing is disposed around the drill pipe string and guides the drill sting during drilling. When the work tool is to be inspected and/or replaced, a manual procedure is employed to prevent the deck bushing from slipping out of the drill string. Further, the deck bushing is to be retained a few inches above the work tool during a replacement process of the work tool. Conventionally, operators many a times have to manually lift the heavy deck bushing.

The manual procedure of holding the deck bushing in contact with the drill string includes halting of the drilling operation and manually inserting a horseshoe plate to secure the deck bushing on the drill string. Subsequently, an operator returns to an operator station of the drilling machine to continue the replacement process of the work tool. Further, after the work tool is replaced, the operator has to manually disengage the horseshoe tool from the deck bushing. Such a manual procedure of retaining the deck bushing is time-consuming as it involves multiple process steps, live work, involves considerable operator involvement, and may cause operator fatigue.

U.S. Application Number 2018/0291696 describes a drill bit changer system for a drill rig including a drill bit storage holder assembly arranged to be movable mounted to the drill rig. The drill bit assembly includes a rotatable drill bit storage holder, a plurality of bit holder receptacles located within the drill bit storage holder, and a plurality of drill bit adaptor assemblies disposed in the bit holder receptacles. Each adaptor assembly includes an adaptor having opposed ends, one end of the adaptor being arranged to engage a drill string of the drill rig and another end of the adaptor being engageable with a drill bit, wherein the adaptor has a rounded section disposed between the opposed ends, the rounded section being engageable by an adaptor arm of the drill bit holder assembly to engage and disengage the drill bit adaptor assembly from the drill string. A method of changing a drill bit is also disclosed.

SUMMARY OF THE DISCLOSURE

In an aspect of the present disclosure, a retention system for retaining a deck bushing of a drilling machine is provided. The deck bushing is movable relative to a drill string of the drilling machine. The retention system includes a pipe rack rotatable between a first pipe rack position and a second pipe rack position. The retention system also includes a retention arm assembly coupled with the pipe rack. The retention arm assembly is rotatable relative to the pipe rack between a first arm position and a second arm position. When the pipe rack is in the first pipe rack position and the retention arm assembly is in the first arm position, the retention arm assembly is disengaged from the deck bushing. When the pipe rack is in the second pipe rack position and the retention arm assembly is in the second arm position, the retention arm assembly is engaged with the deck bushing to retain the deck bushing in a raised state to facilitate an inspection and/or a replacement of a work tool from the drill string of the drilling machine. The retention system further includes a pipe positioner system that contacts the drill string to guide and center a movement of the drill string along a vertical axis before the retention arm assembly engages with the deck bushing. The pipe positioner system includes at least one support arm that contacts the drill string to facilitate the movement of the drill string along the vertical axis.

In another aspect of the present disclosure, a drilling machine is provided. The drilling machine includes a frame. The drilling machine also includes a mast system supported on the frame. The drilling machine further includes a mast weldment coupled to the frame. The drilling machine includes a drill string. The drilling machine also includes a work tool coupled to the drill string. The drilling machine further includes a deck bushing movable relative to the drill string. The drilling machine includes a retention system for retaining the deck bushing in a raised state to facilitate an inspection and/or a replacement of the work tool from the drill string of the drilling machine. The retention system includes a pipe rack coupled to the mast weldment. The pipe rack is rotatable between a first pipe rack position and a second pipe rack position. The retention system also includes a retention arm assembly coupled with the pipe rack. The retention arm assembly is rotatable relative to the pipe rack between a first arm position and a second arm position. When the pipe rack is in the first pipe rack position and the retention arm assembly is in the first arm position, the retention arm assembly is disengaged from the deck bushing. When the pipe rack is in the second pipe rack position and the retention arm assembly is in the second arm position, the retention arm assembly is engaged with the deck bushing to retain the deck bushing in the raised state to facilitate the inspection and/or the replacement of the work tool from the drill string of the drilling machine. The retention system further includes a pipe positioner system coupled to the mast weldment. The pipe positioner system contacts the drill string to guide and center a movement of the drill string along a vertical axis before the retention arm assembly engages with the deck bushing. The pipe positioner system includes at least one support arm that contacts with the drill string to facilitate the movement of the drill string along the vertical axis.

In yet another aspect of the present disclosure, a method for retaining a deck bushing of a drilling machine is provided. The deck bushing is movable relative to a drill string of the drilling machine. The method includes engaging a pipe positioner system with the drill string to guide and center a movement of the drill string along a vertical axis. The pipe positioner system includes at least one support arm that contacts with the drill string to facilitate the movement of the drill string along the vertical axis. The method also includes raising the drill string such that a work tool of the drilling machine is raised above a mast base plate of the drilling machine. The method further includes rotating a pipe rack from a first pipe rack position to a second pipe rack position. The method includes rotating a retention arm assembly from a first arm position to a second arm position. The retention arm assembly is coupled with the pipe rack of the drilling machine. When the retention arm assembly is in the first arm position, the retention arm assembly is disengaged from the deck bushing. The method also includes engaging the retention arm assembly with the deck bushing based on the rotation of the pipe rack to the second pipe rack position. The method further includes retaining, by the retention arm assembly, the deck bushing in a raised state based on an engagement of the retention arm assembly with the deck bushing to facilitate an inspection and/or a replacement of the work tool from the drill string. The method includes disengaging the retention arm assembly and the pipe rack from the deck bushing after the inspection and/or the replacement of the work tool. The method also includes reseating the deck bushing on the mast base plate. The method further includes lowering the drill string of the drilling machine to a Ready-To-Drill state or a Ready-To-Tram state.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
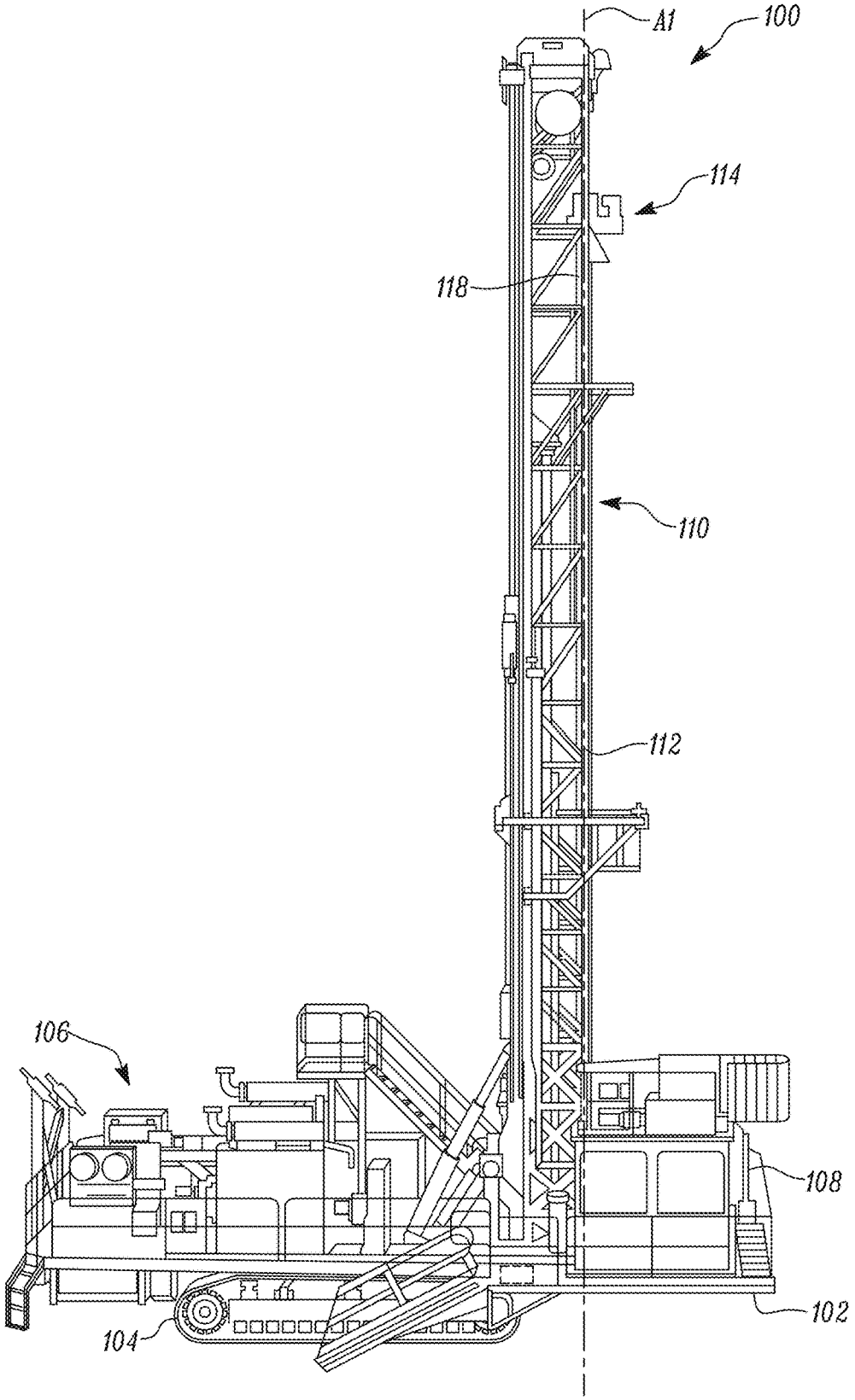
FIG. 1 is a schematic side view of an exemplary drilling machine.

Referring to FIG. 1, a schematic side view of an exemplary drilling machine 100 is illustrated. In the illustrated embodiment of FIG. 1, the drilling machine 100 is a rotary drilling machine. However, the drilling machine 100 may embody any other type of drilling machine, without any limitations. The drilling machine 100 may be a manual, an autonomous, or a semi-autonomous work machine. The drilling machine 100 may be used to perform one or more drilling operations, such as drilling holes, mining blast holes, geothermal wells, and the like. The drilling machine 100 defines a vertical axis A1.

As shown in FIG. 1, the drilling machine 100 includes a frame 102. The frame 102 may be supported on a ground surface by a transport mechanism, such as crawler tracks 104. The crawler tracks 104 may allow the drilling machine 100 to maneuver on ground surfaces to a desired location for performing drilling operations. Alternatively, the drilling machine 100 may include wheels instead of the crawler tracks 104. The frame 102 includes one or more jacks (not shown herein) for supporting and leveling the drilling machine 100 on the ground surface during drilling operations.

The drilling machine 100 also includes a machinery 106. The frame 102 may support the machinery 106, which may include various components (not shown), such as, a power source (for example, an engine, a battery system, and/or a fuel system), motors, pumps, air compressors, and/or any other equipment necessary to supply power to operate the drilling machine 100. The frame 102 further supports an operator cabin 108, from which an operator may maneuver and control the drilling machine 100.

The drilling machine 100 includes a mast system 110 supported on the frame 102. The mast system 110 extends along the vertical axis A1. The mast system 110 includes a mast weldment 112 coupled to the frame 102.

The drilling machine 100 further includes a drill head 114 movable relative to the mast system 110. The drill head 114 is movable along the vertical axis A1 and is supported on the mast system 110. The machinery 106 may provide power to operate the drill head 114 relative to the mast system 110. In some examples, the drilling machine 100 may include one or more motors (not shown) associated with the drill head 114. The drilling machine 100 also includes a hydraulically operated breakout (HOBO) device 140 (shown in FIG. 6) to disengage a work tool 120 (shown in FIG. 2A) of the drilling machine 100 from a drill string 118 (shown in FIG. 2A). The HOBO device 140 includes a conventional HOBO wrench including components and mechanisms known to persons skilled in the art. The HOBO device 140 is a wrench that may be used to grip the drill string 118, and occasionally the work tool 120, to assist in a removal/attachment of the work tool 120 with the drill string 118.

Figure 2A:
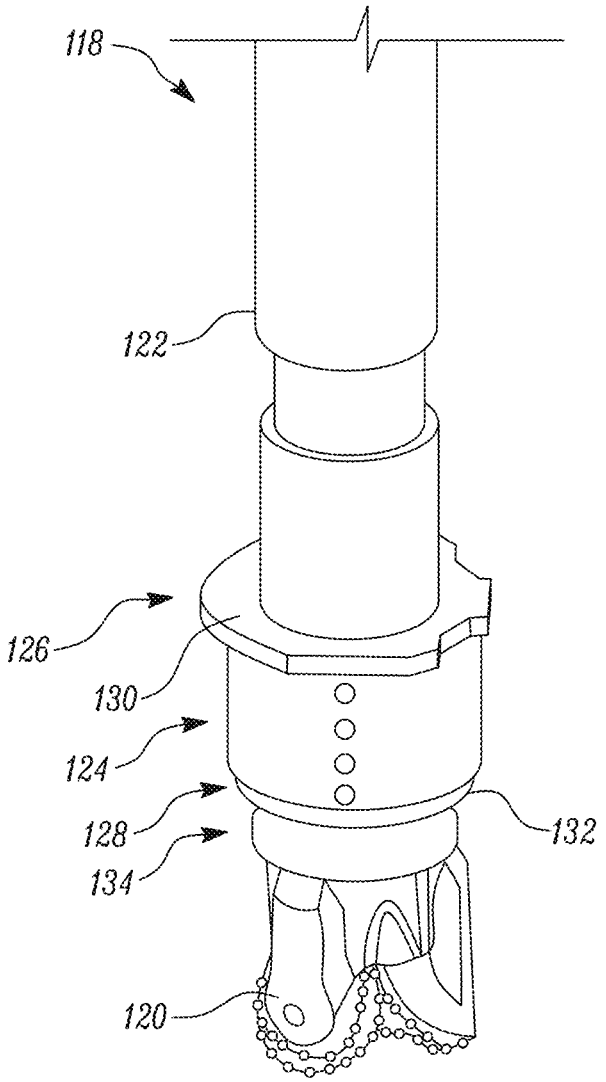
FIG. 2A is a schematic perspective view of a drill string of the drilling machine of FIG. 1.

Referring to FIG. 2A, the drilling machine 100 also includes the drill string 118. Only a portion of the drill string 118 is illustrated in FIG. 2A. The drill head 114 (see FIG. 1) may support the drill string 118. The drill head 114 may couple to, and rotate, the drill string 118 for performing the drilling operation. The drill string 118 defines a bottom end 134. The drilling machine 100 further includes the work tool 120 coupled to the drill string 118. Specifically, the work tool 120 is coupled to the drill string 118 proximal to the bottom end 134 of the drill string 118. The work tool 120 may allow drilling into various surfaces. The work tool 120 may include a drill bit. For example, the work tool 120 may include a rotary drill bit or a down-the-hole (DTH) drill bit. In the illustrated embodiment of FIG. 2A, the work tool 120 is embodied as the rotary drill bit. Alternatively, the work tool 120 may embody any other work tool that can be used to perform drilling operations.

The drill string 118 includes a drill pipe 119 (shown in FIG. 3A), an upper sub adaptor (not shown), and a lower sub adaptor 122. The lower sub adaptor 122 couples the work tool 120 with the drill string 118. In other words, the lower sub adaptor 122 is disposed between the drill pipe 119 and the work tool 120 and allows coupling of the work tool 120 with the drill string 118.

Figure 2B:
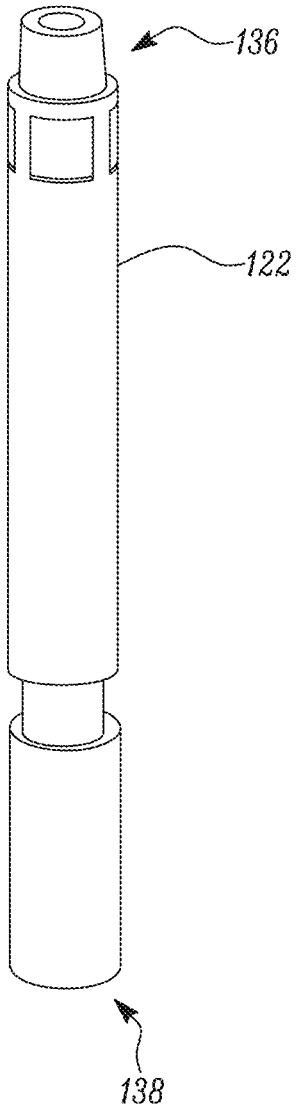
FIG. 2B is a schematic perspective view of a lower sub adaptor of the drill string of FIG. 2A.

Referring now to FIGS. 2A and 2B, the lower sub adaptor 122 includes a first end 136 and a second end 138. The lower sub adaptor 122 is coupled with the drill pipe 119 (see FIG. 3A) proximal to the first end 136. Further, the lower sub adaptor 122 is coupled with the work tool 120 proximal to the second end 138.

Figure 2C:
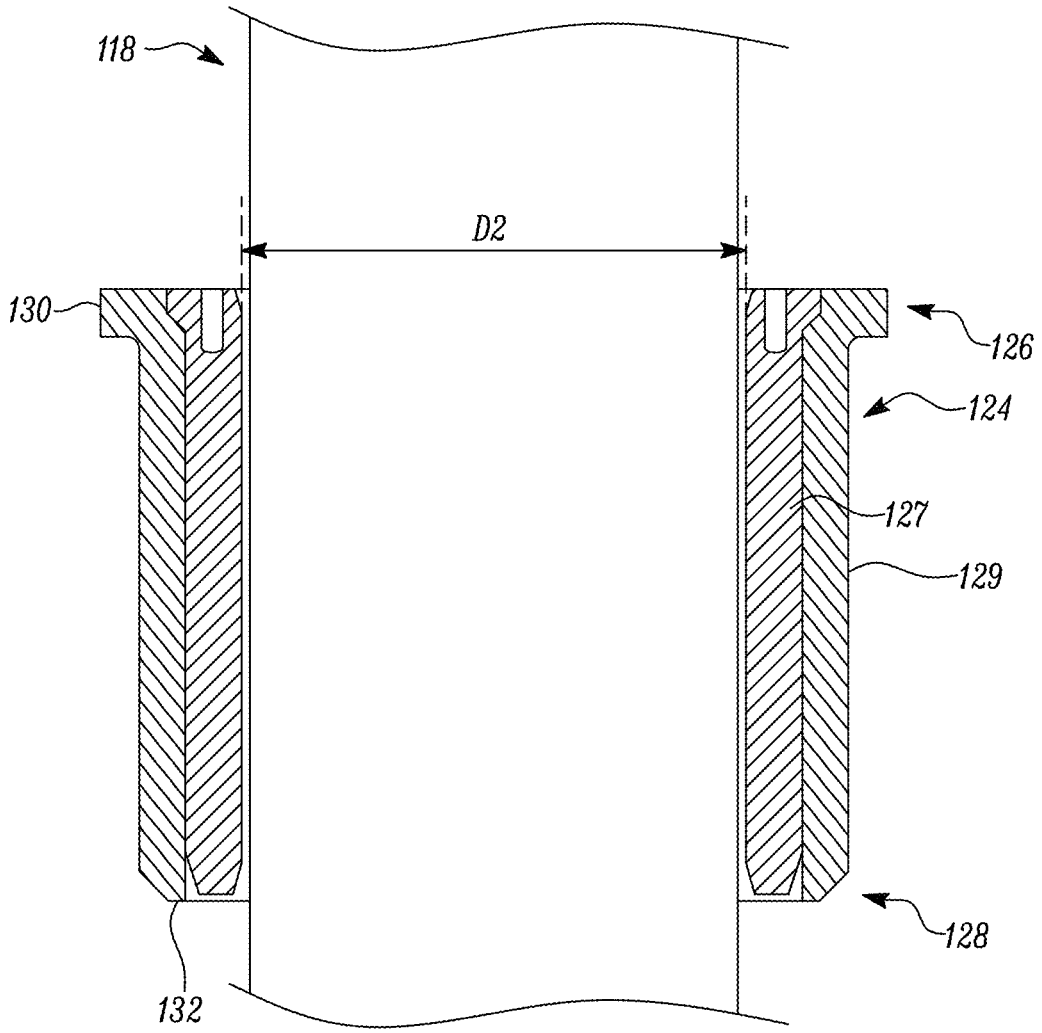
FIG. 2C is a schematic cross-sectional view of a deck bushing of the drilling machine in contact with the drill string of FIG. 2A.

Referring to FIGS. 2A and 2C, the drilling machine 100 includes a deck bushing 124 movable relative to the drill string 118. The deck bushing 124 is mounted on a mast base plate 125 (shown in FIG. 6) of the drilling machine 100. The deck bushing 124 guides and supports the drill string 118 during the drilling operation. In an example, when the drilling machine 100 trams from hole to hole, the deck bushing 124 fits into the mast base plate 125. Further, the work tool 120 that is mounted to the second end 138 of the lower sub adaptor 122, lies below the mast base plate 125 to perform the drilling operation. The deck bushing 124 is movable relative to the drill string 118 of the drilling machine 100 between a raised state and a lowered state. In the lowered state of the deck bushing 124, the deck bushing 124 may fit flat on to the mast base plate 125. The deck bushing 124 is moved to the raised state during an inspection and/or a replacement of the work tool 120 from the drill string 118 of the drilling machine 100. Specifically, the drill string 118 is raised to a pre-defined height during the inspection and/or the replacement of the work tool 120 from the drill string 118. The deck bushing 124 defines an upper end 126 and a lower end 128 opposite the upper end 126. The deck bushing 124 includes a flange 130 defined at the upper end 126 and a bottom surface 132 defined at the lower end 128. Further, the deck bushing 124 defines an inner diameter D2.

The deck bushing 124 is embodied as a plain sleeve type deck bushing in FIG. 2C. However, the deck bushing 124 may embody a ball bearing sleeve type deck bushing. The deck bushing 124 includes an inner sleeve 127 and an outer sleeve 129. The inner sleeve 127 rotates with respect to the outer sleeve 129. The outer sleeve 129 may remain static on the drill string 118 during the drilling operation.

Figure 3A:
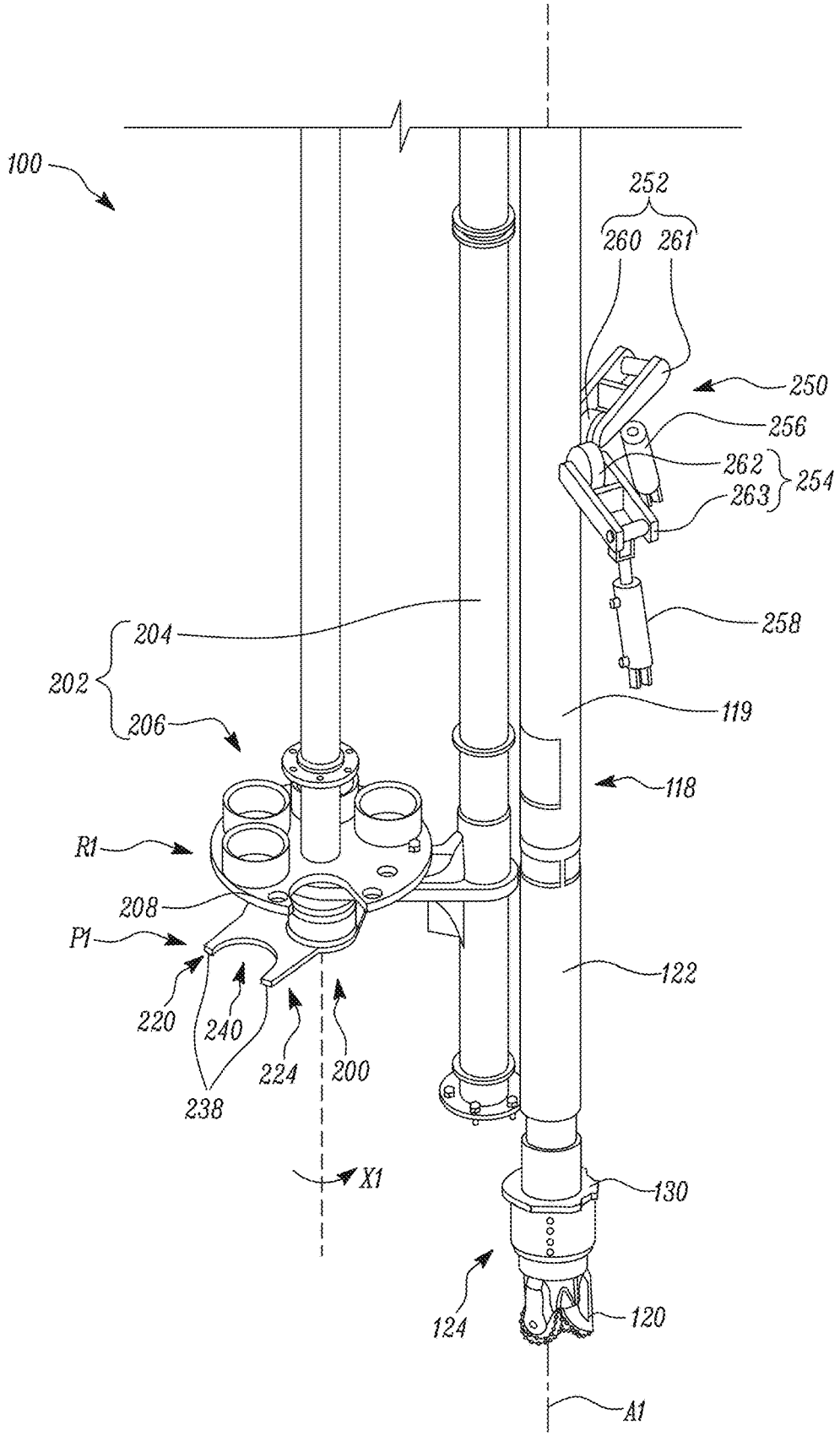
FIG. 3A is a schematic perspective view of a retention system of the drilling machine of FIG. 1 illustrating a pipe rack in a first pipe rack position and a retention arm assembly in a first arm position, according to an embodiment of the present disclosure.

With reference to FIGS. 3A, the drilling machine 100 includes a retention system 200 for retaining the deck bushing 124 in the raised state to facilitate the inspection and/or the replacement of the work tool 120 from the drill string 118 of the drilling machine 100. The retention system 200 includes a pipe rack 202. The pipe rack 202 is coupled to the mast system 110 (see FIG. 1). Specifically, the pipe rack 202 is coupled to the mast weldment 112 (see FIG. 1). In an example, the pipe rack 202 may be mounted on the mast weldment 112 on two bearings (not shown) proximate to a top end and a bottom end of the pipe rack 202.

The pipe rack 202 includes a central support 204 and a carousel 206 coupled to the central support 204. The carousel 206 includes a base 208. The base 208 is embodied as a plate that is substantially circular in shape.

The carousel 206 may support one or more drill strings (not shown) and/or one or more drill pipes (not shown). Specifically, the carousel 206 may include coupling provisions to support one or more drill strings (similar to the drill string 118) and/or one or more drill pipes (similar to the drill pipe 119). Further, the carousel 206 may dispense and assist in engagement of the drill strings and/or the drill pipes with the drill head 114, as required.

The pipe rack 202 is rotatable between a first pipe rack position R1 and a second pipe rack position R2. The drilling machine 100 may include an actuator (not shown) to rotate the pipe rack 202 between the first pipe rack position R1 and the second pipe rack position R2. The pipe rack 202 is illustrated in the first pipe rack position R1 in FIG. 3A. Further, the pipe rack 202 is illustrated in the second pipe rack position R2 in FIGS. 3C and 3D. During operation of the drilling machine 100, the pipe rack 202 may rotate to the second pipe rack position R2 from the first pipe rack position R1 to load/unload the drill strings or the drill pipes. Further, the pipe rack 202 may rotate back to the first pipe rack position R1 from the second pipe rack position R2 after loading or unloading the drill strings or the drill pipes. The pipe rack 202 may further rotate to a third pipe rack position (not shown) to remove or add one or more drill pipes to the drill string 118 in a multi-pass drilling. In some examples, the third pipe rack position may be similar to the second pipe rack position R2. In other examples, the third pipe rack position may not be similar to the second pipe rack position R2.

Figure 3B:
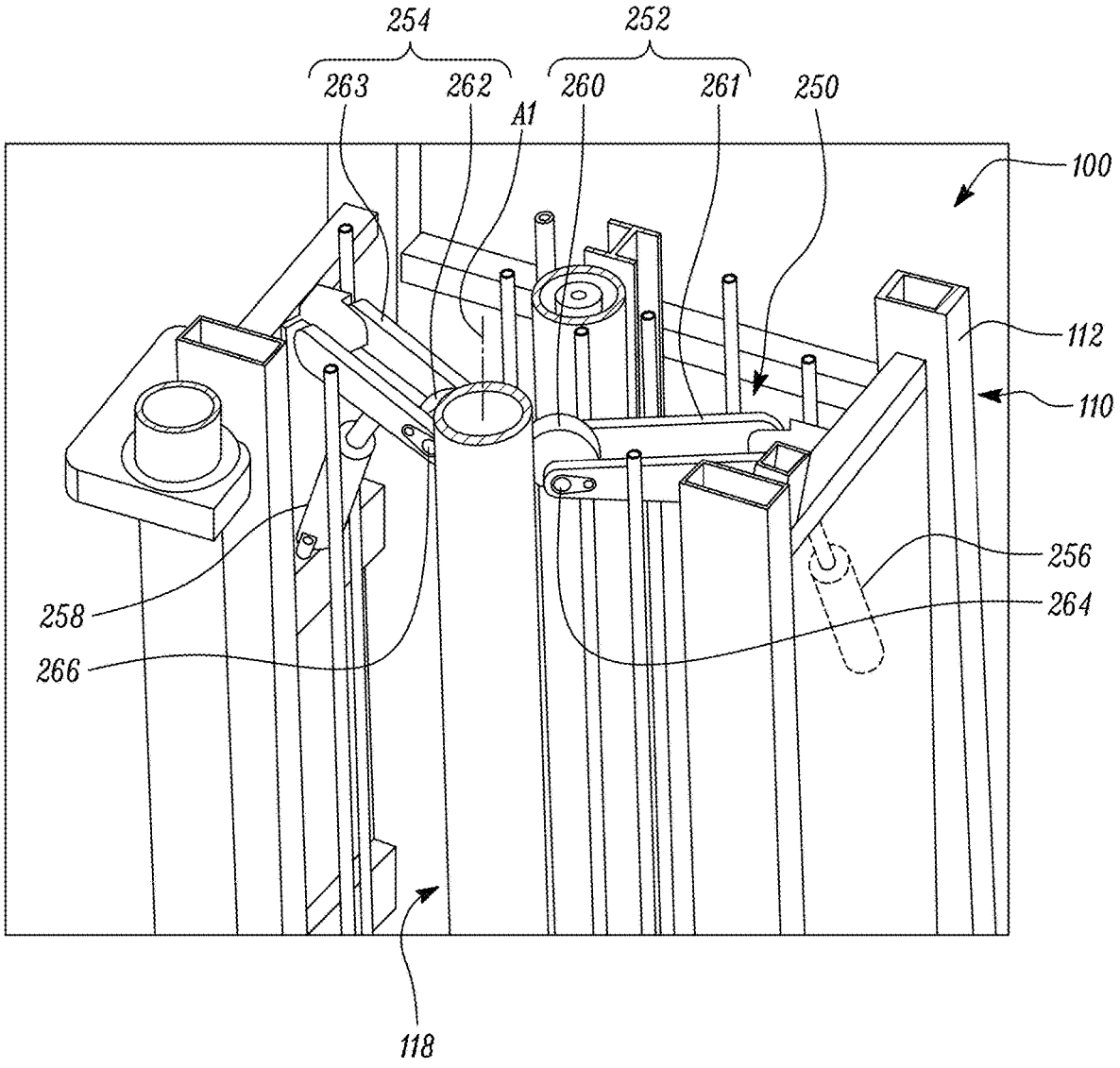
FIG. 3B is a top sectional view of a portion of the drilling machine illustrating a pipe positioner system of the retention system of FIG. 3A.
Figure 3C:
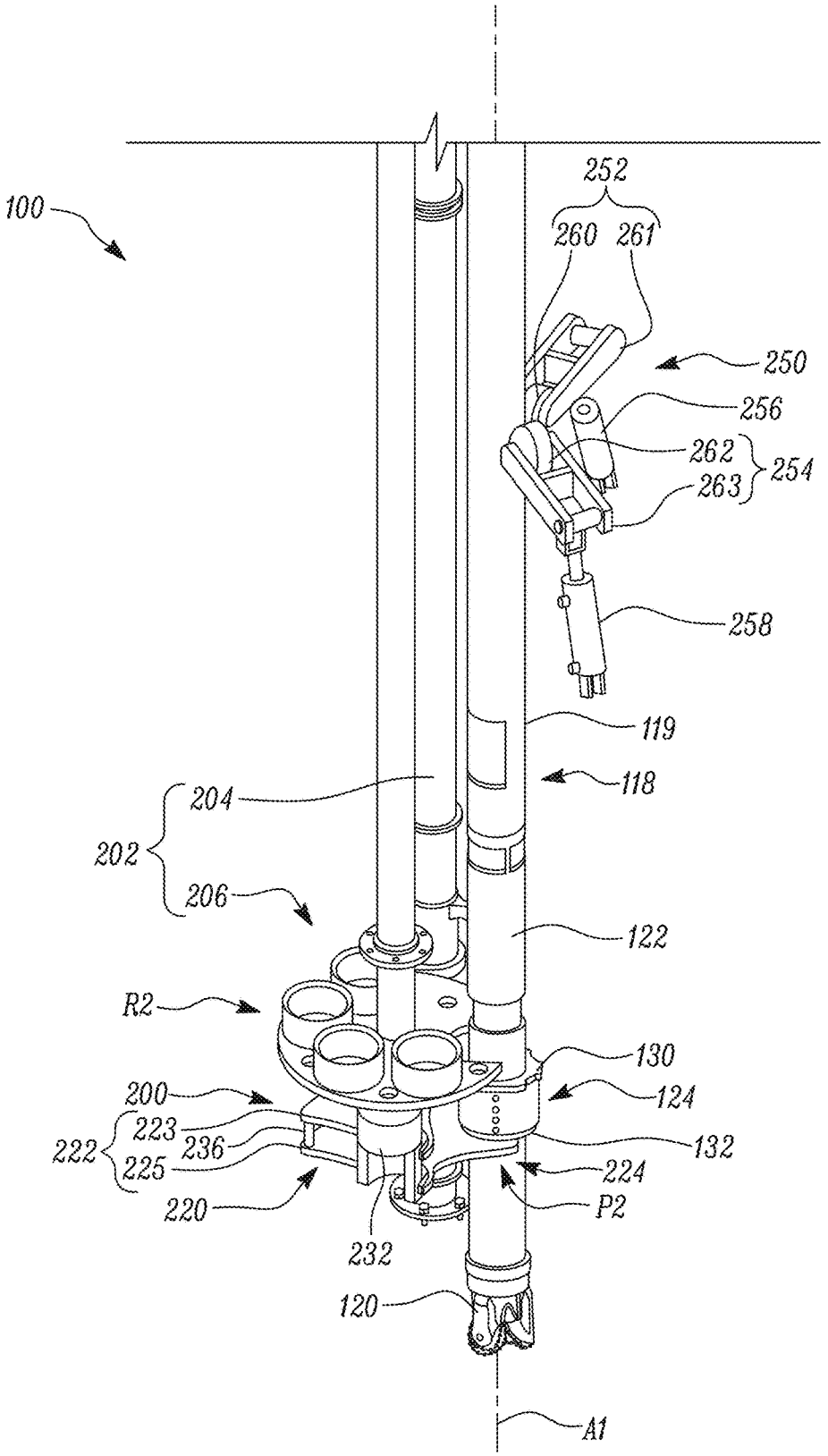
FIGS. 3C and 3D are schematic perspective views of the retention system and the pipe positioner system illustrating the pipe rack in a second pipe rack position and the retention arm assembly in a second arm position.

Referring now to FIGS. 3A to 3C, the retention system 200 further includes a pipe positioner system 250. The pipe positioner system 250 is coupled to the mast weldment 112. The pipe positioner system 250 contacts the drill string 118 to guide and center a movement of the drill string 118 along the vertical axis A1. Specifically, the pipe positioner system 250 contacts the drill pipe 119 (see FIG. 3A). It should be noted that the vertical axis A1 is defined as an axis that passes through a drill center hole 131 (shown in FIG. 6) on the mast base plate 125 (see FIG. 6). In other words, the pipe positioner system 250 centers and guides the drill string 118 to drill a hole (not shown) that is perpendicular to the mast base plate 125 and is straight in geometry.

The pipe positioner system 250 includes one or more support arms 252, 254 that contacts with the drill string 118 to facilitate the movement of the drill string 118 along the vertical axis A1. Specifically, the one or more support arms 252, 254 includes a first support arm 252 and a second support arm 254. Each of the first support arm 252 and the second support arm 254 are distant from each other and are disposed at an angle from each other. In some examples, each of the first support arm 252 and the second support arm 254 may be disposed opposite to each other. The first support arm 252 includes a first arm 261 and a first roller 260. The first roller 260 is coupled to the first arm 261 via one or more fastening means 264. The second support arm 254 includes a second arm 263 and a second roller 262. The second roller 262 is coupled to the second arm 263 via one or more fastening means 266. In some examples, the one or more fastening means 264, 266 may include a bolt, a screw, a rivet, and the like. One end of each of the first arm 261 and the second arm 263 is coupled with the mast system 110, whereas another end of each of the first arm 261 and the second arm 263 engages with the drill string 118.

The pipe positioner system 250 further includes a first actuator 256 associated with the first support arm 252 and a second actuator 258 associated with the second support arm 254. The first actuator 256 is coupled to the first arm 261 at one end and to the mast system 110 at another end. The second actuator 258 is coupled to the second arm 263 at one end and to the mast system 110 at another end.

Based on an extension of the first actuator 256, the first support arm 252 contacts with the drill string 118. In other words, based on the extension of the first actuator 256, the first support arm 252 moves angularly such that the first roller 260 contacts with the drill string 118. Further, based on an extension of the second actuator 258, the second support arm 254 contacts with the drill string 118. In other words, based on the extension of the second actuator 258, the second support arm 254 moves angularly such that the second roller 262 contacts with the drill string 118. It should be noted that the pipe positioner system 250 may include one or more arms with guiding elements of various geometries other than rollers 260, 262 without any limitations.

The retention system 200 also includes a retention arm assembly 220 coupled with the pipe rack 202. The retention arm assembly 220 may be removably coupled to the central support 204 or the carousel 206. In other examples, the retention arm assembly 220 may be fixedly coupled to the central support 204 or the carousel 206. In the illustrated embodiment of FIGS. 3A to 3D, the retention arm assembly 220 is coupled with the carousel 206. Specifically, the retention arm assembly 220 is removably coupled with the carousel 206. The retention arm assembly 220 is rotatable relative to the pipe rack 202 between a first arm position P1 and a second arm position P2. The retention arm assembly 220 is illustrated in the first arm position P1 in FIG. 3A. Further, the retention arm assembly 220 is illustrated in the second arm position P2 in FIGS. 3C and 3D.

The retention arm assembly 220 includes a coupling member 222 that couples the retention arm assembly 220 with the pipe rack 202. In the illustrated embodiment of FIGS. 3A to 3D, the coupling member 222 includes a first coupling portion 223 and a second coupling portion 225 distal from the first coupling portion 223. Each of the first and second coupling portions 223, 225 is coupled with the base 208 of the carousel 206 via a first coupling unit 232 and a second coupling unit 234. Further, each of the first coupling portion 223 and the second coupling portion 225 is coupled via a pin 236. In an example, each of the first and second coupling portions 223, 225 may be fixedly or removably coupled with the first coupling unit 232 via any means known to persons skilled in the art. In some examples, the retention arm assembly 220 includes one or more fastening members 226 that removably couple the coupling member 222 of the retention arm assembly 220 with the pipe rack 202. Specifically, the fastening members 226 couple the second coupling portion 225 with the second coupling unit 234.

In another example, each of the first and second coupling portions 223, 225 may be fixedly coupled with the first coupling unit 232 via welding, soldering, brazing, and the like. In yet another example, the coupling member 222 may simply surround the first coupling unit 232, while the coupling member 222 may be removably or fixedly coupled with the second coupling unit 234. It should be noted that the present disclosure is not limited to a technique of coupling the retention arm assembly 220 with the pipe rack 202.

In some examples, the second coupling unit 234 is rotatable relative to the carousel 206 to move the retention arm assembly 220 between the first and second arm positions P1, P2. The retention system 200 may include an actuator (not shown but similar to an actuator 1052 shown in FIGS. 10B and 10C) that may cause the retention arm assembly 220 and the second coupling unit 234 to rotate relative to the carousel 206 thereby moving the retention arm assembly 220 between the first and second arm positions P1, P2.

The retention arm assembly 220 further includes an engaging portion 224 coupled with the coupling member 222. In the illustrated embodiment of FIGS. 3A to 3D, the engaging portion 224 is integral with the coupling member 222. In another example, the engaging portion 224 may be removably or fixedly coupled with the coupling member 222. As is apparent from FIG. 3A, the engaging portion 224 includes a pair of arms 238. The pair of arms 238 define a C-shape herein. Alternatively, the pair of arms 238 may have any other shape, such as a U-shape, an arc shape, and so on, that may allow retention of the deck bushing 124. Further, the pair of arms 238 are spaced apart from each other such that a slot 240 is defined therebetween.

As is apparent from FIG. 3A, when the pipe rack 202 is in the first pipe rack position R1 and the retention arm assembly 220 is in the first arm position P1, the retention arm assembly 220 is disengaged from the deck bushing 124.

Figure 3D:
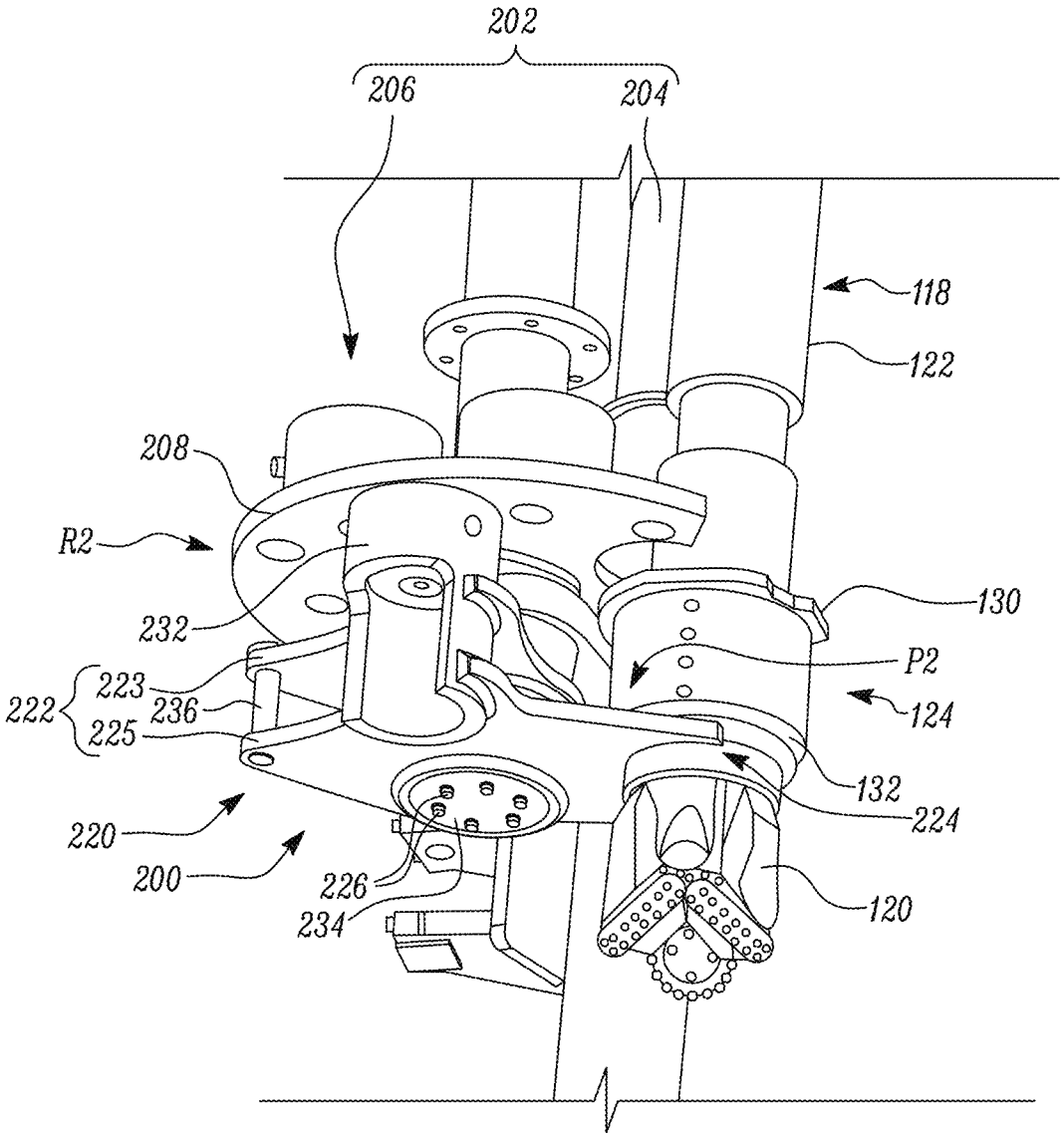

Further, with reference to FIGS. 3C and 3D, when the pipe rack 202 is in the second pipe rack position R2 and the retention arm assembly 220 is in the second arm position P2, the retention arm assembly 220 is engaged with the deck bushing 124 to retain the deck bushing 124 in the raised state to facilitate the inspection and/or the replacement of the work tool 120 from the drill string 118 of the drilling machine 100. Specifically, to engage the retention arm assembly 220 with the deck bushing 124, the retention arm assembly 220 is rotated to the second arm position P2 from the first arm position P1 followed by a rotation of the pipe rack 202 to the second pipe rack position R2 from the first pipe rack position R1. In other words, the retention arm assembly 220 is first rotated along an anticlockwise direction X1 about the pipe rack 202 to the second arm position P2. Subsequently, the pipe rack 202 is rotated along the anticlockwise direction X1 to the second pipe rack position R2. Further, the pipe positioner system 250 contacts the drill string 118 to guide and center the movement of the drill string 118 along the vertical axis A1 before the retention arm assembly 220 engages with the deck bushing 124. In other words, the pipe positioner system 250 guides the movement of the drill string 118 along the vertical axis A1 and may minimize the shifting of the drill pipe 119 and/or the drill string 118 before the retention arm assembly 220 engages with the deck bushing 124.

When the pipe rack 202 is in the second pipe rack position R2 and the retention arm assembly 220 is in the second arm position P2, the engaging portion 224 is engaged with the deck bushing 124. When the pipe rack 202 is in the second pipe rack position R2 and the retention arm assembly 220 is in the second arm position P2, the engaging portion 224 may be engaged with the flange 130 of the deck bushing 124 or the bottom surface 132 of the deck bushing 124. In the illustrated embodiment of FIGS. 3C and 3D, the engaging portion 224 of the retention arm assembly 220 is illustrated in engagement with the bottom surface 132 of the deck bushing 124. Thus, when the pipe rack 202 is in the second pipe rack position R2 and the retention arm assembly 220 is in the second arm position P2, the slot 240 receives a portion of the lower sub adaptor 122 therein to engage the retention arm assembly 220 with the bottom surface 132 of the deck bushing 124 to retain the deck bushing 124 in the raised state.

Further, when the retention arm assembly 220 is to be disengaged from the deck bushing 124, the pipe rack 202 is first rotated to the first pipe rack position R1 in a clockwise direction (opposite to the anticlockwise direction X1) followed by a rotation of the retention arm assembly 220 in the clockwise direction (opposite to the anticlockwise direction X1). It should be noted that the pipe rack 202 may be coupled on either side of the mast system 110 (see FIG. 1). In some examples, the pipe rack 202 may be mounted to a side (other than shown in FIG. 3A) of the mast system 100. Further, in such examples, when the retention arm assembly 220 is to be engaged with the deck bushing 124, the pipe rack 202 is rotated in the clockwise direction followed by the rotation of retention arm assembly 220 in the clockwise direction. Furthermore, when the retention arm assembly 220 is to be disengaged from the deck bushing 124, the pipe rack 202 is first rotated in the anticlockwise direction followed by the rotation of the retention arm assembly 220 in the anticlockwise direction.

Figure 4A:
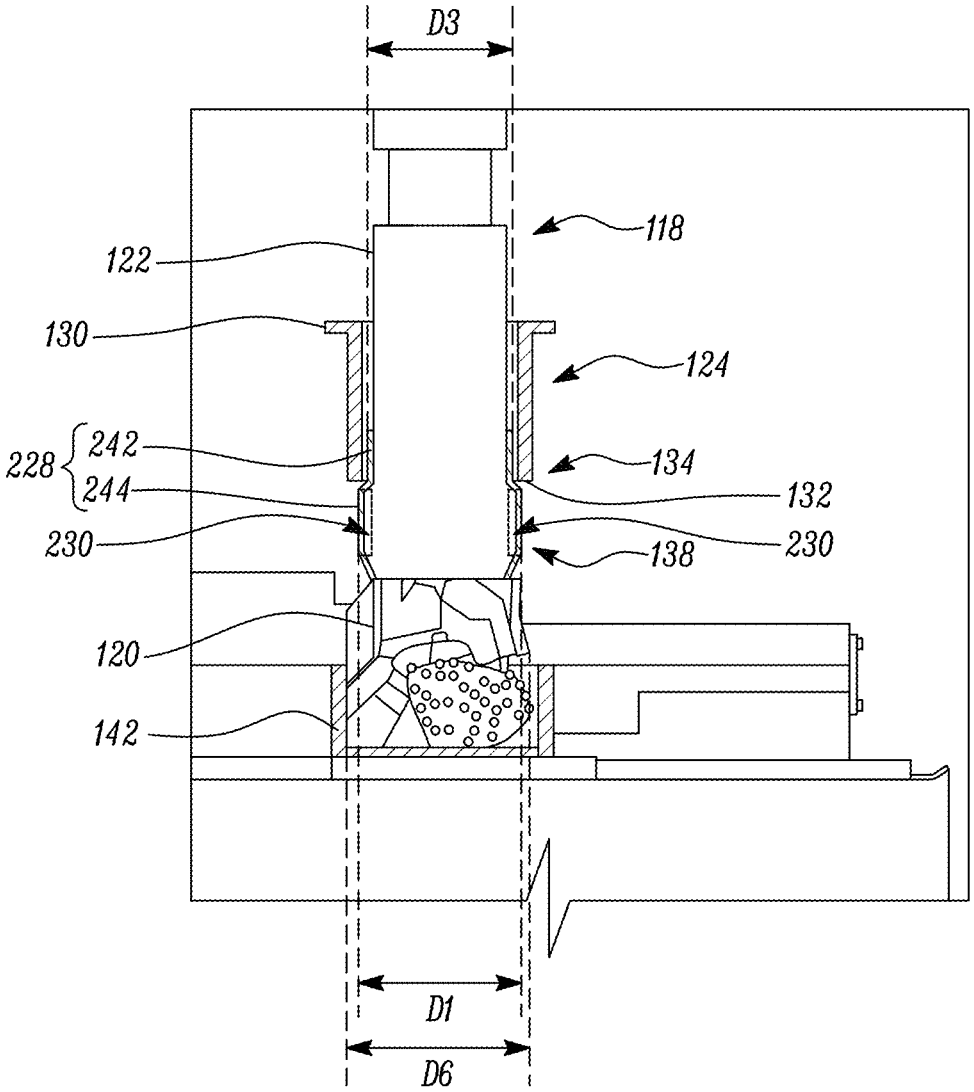
FIG. 4A is a schematic view illustrating a retention element of the retention system of FIG. 3A engaged with a deck bushing of the drilling machine, according to an embodiment of the present disclosure.

Referring now to FIG. 4A, the retention system 200 further includes a retention element 228 coupled proximal to the bottom end 134 of the drill string 118. Specifically, the retention element 228 is disposed at the second end 138 of the lower sub adaptor 122. The retention element 228 may be integral with the drill string 118 or fixedly coupled with the drill string 118. In an example, the retention element 228 may be fixedly coupled with the lower sub adaptor 122 by welding, soldering, brazing, and the like. In other examples, the retention element 228 may be removably coupled with the drill string 118 for example, via one or more fastening elements.

The retention element 228 defines a maximum diameter D1 that is greater than the inner diameter D2 (see FIG. 2C) of the deck bushing 124. In some examples, the maximum diameter D1 may be greater than the inner diameter D2 but less than an outer diameter defined at the bottom surface 132 of the deck bushing 124. Further, a diameter D6 of the work tool 120 is greater than the maximum diameter D1.

Furthermore, a location of the retention element 228 is based on a type of the work tool 120 associated with the drilling machine 100. Specifically, in the illustrated embodiment of FIG. 4A, the work tool 120 is the rotary drill bit, and the retention element 228 is disposed at the second end 138 of the lower sub adaptor 122. The retention element 228 has a stepped profile herein. The retention element 228 includes a first portion 242 and a second portion 244. The first portion 242 has an outer diameter D3 that is lesser than the inner diameter D2 of the deck bushing 124. When the deck bushing 124 engages with the retention element 228, the first portion 242 is received within the deck bushing 124. Further, the second portion 244 defines the maximum diameter D1 that is greater than the outer diameter D3 of the first portion 242 and is greater than the inner diameter D2 of the deck bushing 124, such that the bottom surface 132 rests on the second portion 244 to engage the deck bushing 124 with the retention element 228.

The retention element 228 defines a number of passages 230 to purge out air and/or debris. Specifically, the number of passages 230 may purge out air and/or debris during the drilling operation. Specifically, the debris may be drilling debris generated during the drilling operation. The passages 230 extend along the vertical axis A1 (see FIG. 1). The retention element 228 may define any number of passages 230, such as three, four, five, six, and so on, as per application attributes.

Referring to FIGS. 3A, 3C, and 4A, when the pipe rack 202 is rotated to the first pipe rack position R1 from the second pipe rack position R2 and the retention arm assembly 220 is rotated to the first arm position P1 from the second arm position P2 after the inspection and/or the replacement of the work tool 120 from the drill string 118, the retention element 228 is engaged with the deck bushing 124 to retain the deck bushing 124 on the drill string 118. Specifically, the retention element 228 retains the deck bushing 124 in the lowered state after the inspection and/or the replacement of the work tool 120 from the drill string 118. In other words, after the inspection and/or the replacement of the work tool 120 from the drill string 118, the drill string 118 (along with the retention element 228) is raised. Further, the retention element 228 engages with the deck bushing 124 to retain the deck bushing 124 on the drill string 118, soon after the pipe rack 202 moves to the first pipe rack position R1 from the second pipe rack position R2 and the retention arm assembly 220 is disengaged from the deck bushing 124.

Figure 4B:
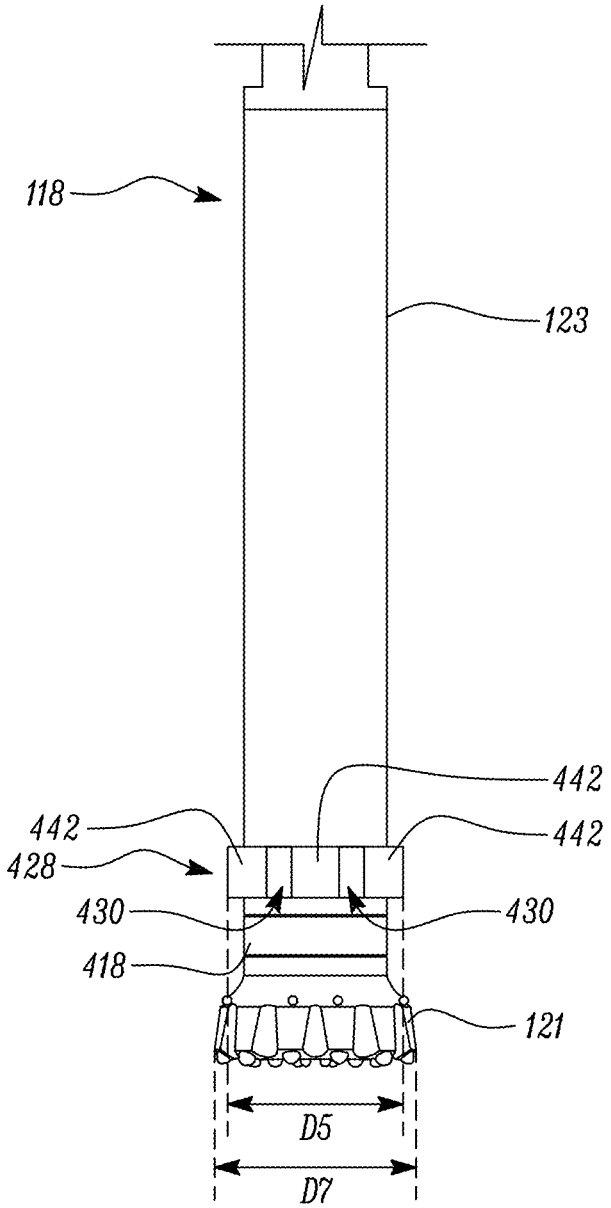
FIG. 4B is a schematic view illustrating a retention element of the retention system of FIG. 3A, according to another embodiment of the present disclosure.

FIG. 4B is a schematic view illustrating a retention element 428 of the retention system 200 of FIG. 3, according to another embodiment of the present disclosure. In the illustrated embodiment of FIG. 4B, a work tool 121 associated with the drilling machine 100 (see FIG. 1) is the DTH drill bit.

The drill string 118 also includes a hammer 123. The hammer 123 is disposed between the lower sub adaptor 122 (see FIG. 4A) and the work tool 121. Further, in the illustrated embodiment of FIG. 4B, the retention element 428 is disposed on the hammer 123 instead of the lower sub adaptor 122. The retention element 428 is disposed proximal to an end of the hammer 123 to which the work tool 121 is coupled. The hammer 123 includes a chuck 418. The retention element 428 is disposed proximal to the chuck 418. In other examples, the retention element 428 may be disposed midway along the hammer 123, or at any other location on the hammer 123, without any limitations. The retention element 428 may be integral with the drill string 118 or fixedly coupled with the drill string 118. In an example, the retention element 428 may be fixedly coupled with the hammer 123 by welding, soldering, brazing, and the like. In other examples, the retention element 428 may be removably coupled with the drill string 118 for example, via one or more fastening elements.

The retention element 428 is designed as a collar herein. The retention element 428 includes a number of engaging portions 442. The retention element 428 may include any number of engaging portions 442, such as three, four, five, six, and so on, based on application attributes. The retention element 428 defines a maximum diameter D5 that is greater than the inner diameter D2 (see FIG. 2C) of the deck bushing 124 (see FIG. 4A), such that the bottom surface 132 (see FIG. 4A) of the deck bushing 124 can rest on the engaging portions 442 to engage the deck bushing 124 with the retention element 428. Specifically, the number of engaging portions 442 together define the maximum diameter D5. Further, a diameter D7 of the work tool 121 is greater than the maximum diameter D5.

The retention element 428 defines a number of passages 430 to purge out air and/or debris. Specifically, the number of passages 430 may purge out air and/or debris during the drilling operation. The passages 430 extend along the vertical axis A1 (see FIG. 1). Each passage 430 is defined between a pair of adjacent engaging portions 442. The retention element 428 may include any number of passages 430, such as three, four, five, six, and so on, based on the number of engaging portions 442.

Figure 4C:
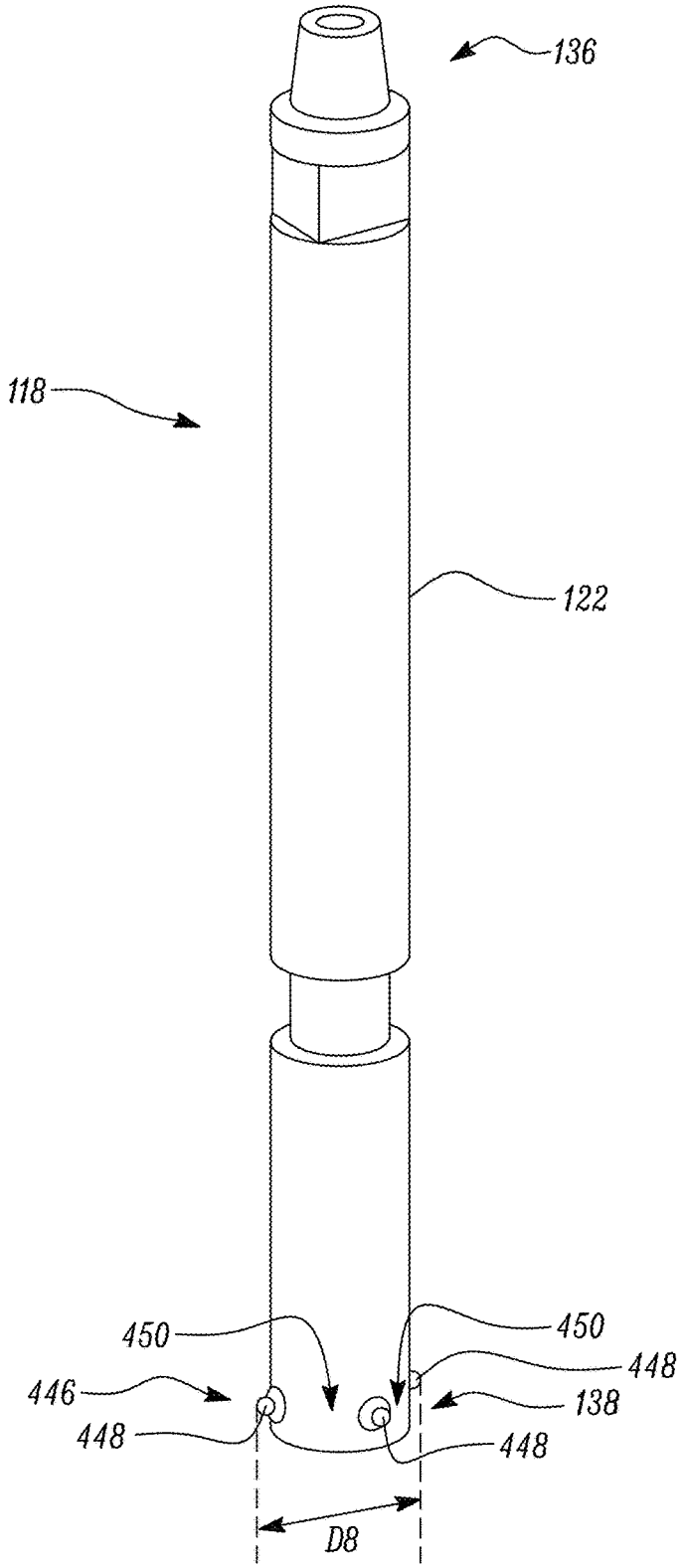
FIG. 4C is a schematic view illustrating a retention element of the retention system of FIG. 3A, according to yet another embodiment of the present disclosure.

FIG. 4C is a perspective view illustrating a retention element 446 of the retention system 200, according to yet another embodiment of the present disclosure. In the illustrated embodiment of FIG. 4C, the retention element 446 includes a number of projections 448. The retention element 446 is disposed proximal to the second end 138 of the lower sub adaptor 122. In other examples, the retention element 446 may be disposed midway along the lower sub adaptor 122, or at any other location on the lower sub adaptor 122, without any limitations. The retention element 446 may be integral with the drill string 118 or fixedly coupled with the drill string 118. In an example, the retention element 446 may be fixedly coupled with the lower sub adaptor 122 by welding, soldering, brazing, and the like. In other examples, the retention element 446 may be removably coupled with the drill string 118 for example, via one or more fastening elements.

The retention element 446 may include any number of projections 448, such as three, four, five, six, and so on, based on application attributes. The retention element 446 defines a maximum diameter D8 that is greater than the inner diameter D2 (see FIG. 2C) of the deck bushing 124 (see FIG. 4A), such that the bottom surface 132 (see FIG. 4A) of the deck bushing 124 rests on the projections 448 to engage the deck bushing 124 with the retention element 446. Specifically, the number of projections 448 together define the maximum diameter D8. The retention element 446 can be used with the rotary drill bit or the DTH drill bit. Further, the diameter D6, D7 (see FIGS. 4A and 4B) of the work tool 120, 121 (see FIGS. 4A and 4B) is greater than the maximum diameter D8.

The retention element 446 defines a number of passages 450 to purge out air and/or debris. Specifically, the number of passages 450 may purge out air and/or debris during the drilling operation. Specifically, the debris may be drilling debris generated during the drilling operation. Each passage 450 is defined between a pair of adjacent projections 448. The retention element 446 may define any number of passages 450, such as three, four, five, six, and so on, based on the number of projections 448.

Figure 4D:
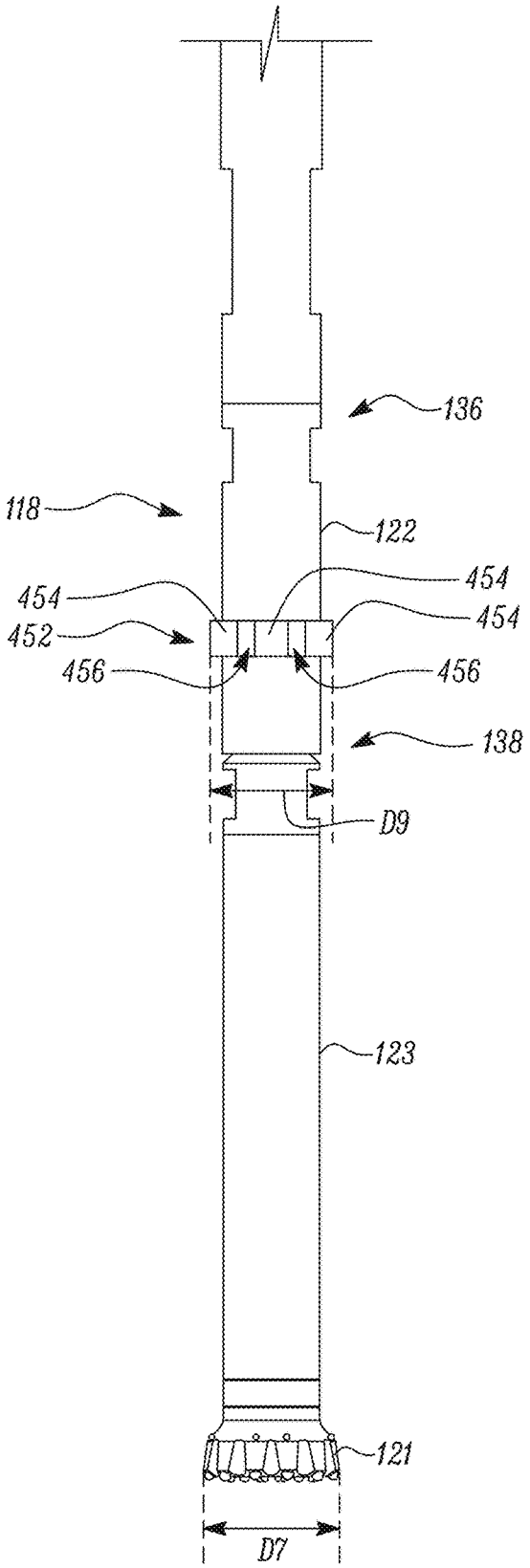
FIG. 4D is a schematic view illustrating a retention element of the retention system of FIG. 3A, according to an embodiment of the present disclosure.

FIG. 4D is a schematic view illustrating a retention element 452 of the retention system 200 of FIG. 3A, according to an embodiment of the present disclosure. In the illustrated embodiment of FIG. 4D, the work tool 121 is the DTH drill bit. The drill string 118 also includes the hammer 123. The hammer 123 is disposed between the lower sub adaptor 122 and the work tool 121. Further, in the illustrated embodiment of FIG. 4D, the retention element 452 is disposed on the lower sub adaptor 122. The retention element 452 is disposed on the lower sub adaptor 122 for retention of the deck bushing 124 (see FIG. 4A) on the drill string 118 when the hammer 123 is to be replaced. Specifically, the retention element 452 is disposed proximal to the second end 138 of the lower sub adaptor 122. In other examples, the retention element 452 may be disposed midway along the lower sub adaptor 122, or at any other location on the lower sub adaptor 122, without any limitations. The retention element 452 may be integral with the drill string 118 or fixedly coupled with the drill string 118. In an example, the retention element 452 may be fixedly coupled with the lower sub adaptor 122 by welding, soldering, brazing, and the like. In other examples, the retention element 452 may be removably coupled with the drill string 118 for example, via one or more fastening elements.

The retention element 452 is designed as a collar herein. The retention element 452 includes a number of engaging portions 454. The retention element 452 may include any number of engaging portions 454, such as three, four, five, six, and so on, based on application attributes. The engaging portions 454 defines a maximum diameter D9 that is greater than the inner diameter D2 (see FIG. 2C) of the deck bushing 124, so that the bottom surface 132 (see FIG. 4A) of the deck bushing 124 can rest on the engaging portions 454 to engage the deck bushing 124 with the retention element 452. Specifically, the number of engaging portions 454 together define the maximum diameter D9. The retention element 452 can be used with rotary drill bits or DTH drill bits. Further, the diameter D7 of the work tool 121 is greater than the maximum diameter D9 of the retention element 452.

The retention element 452 defines a number of passages 456 to purge out air and/or debris. Specifically, the number of passages 456 may purge out air and/or debris during the drilling operation. The passages 456 extend along the vertical axis A1 (see FIG. 1). Each passage 456 is defined between a pair of adjacent engaging portions 454. The retention element 452 may include any number of passages 456, such as three, four, five, six, and so on, based on the number of engaging portions 454.

Referring to FIGS. 4A to 4D, it should be noted that the retention system 200 may include the retention element 228, 428, 446, 452 only when a bit basket 142 (schematically shown in FIG. 4A) of the drilling machine 100 is operated automatically. The bit basket 142 may be a hydraulically operated bit basket. Further, the retention system 200 may not include the retention element 228, 428, 446, 452 when the bit basket 142 is operated manually. The bit basket 142 engages with the work tool 120, 121 when the work tool 120, 121 is to be removed/replaced. Further, the retention element 228, 428, 446, 452 may be used to break a joint between the work tools 120, 121 (or the hammer 123) and the lower sub adaptor 122 in an above-the-deck process, while a replacement of the work tools 120, 121 (or the hammer 123) may be performed using a below-the-deck process.

Referring to FIGS. 2A to 4A, in one exemplary application, the pipe positioner system 250 engages with the drill string 118. Further, when the work tool 120 is to be inspected and/or replaced, the drill string 118, along with the deck bushing 124, is raised to a desired height. Specifically, the drill string 118 is raised to the desired height such that the work tool 120 is raised above the mast base plate 125 to enable the bit basket 142 of the drilling machine 100 to slide below the work tool 120 in case of inspection and/or replacement of the work tool 120. In some examples, the bit basket 142 may be a hydraulically operated bit basket. It should be noted that, in such cases the deck bushing 124 rides on the work tool 120 and is in alignment with the retention arm assembly 220 for engagement. In other words, when the drill string 118 is being raised, the deck bushing 124 is in the lowered state and is engaged with the retention element 228. Further, the retention arm assembly 220 is rotated to the second arm position P2 from the first arm position P1 and the pipe rack 202 is rotated to the second pipe rack position R2 from the first pipe rack rotation R1. Based on the rotation of the pipe rack 202 and the retention arm assembly 220, the retention arm assembly 220 is engaged with the deck bushing 124. The drill string 118 is moved downwards so that the work tool 120 engages with the bit basket 142. At this time, the retention arm assembly 220 is still engaged with the deck bushing 124 to retain the deck bushing 124 in the raised state for the inspection and/or the replacement of the work tool 120 from the drill string 118 of the drilling machine 100. Subsequently, the HOBO device 140 (see FIG. 6) breaks a joint between the work tool 120 and the lower sub adaptor 122, while the work tool 120 will be retained in the bit basket 142 and will be replaced with a new work tool.

Even after the joint between the work tool 120 and the lower sub adaptor 122 is broken, the retention arm assembly 220 remains engaged till the work tool 120 is removed and replaced with the new work tool. After the work tool 120 replacement on the drill string 118, the drill string 118 is raised up till the deck bushing 124 rides on the work tool 120 once again. Then the pipe rack 202 is rotated to the first pipe rack position R1 from the second pipe rack rotation R2 and the retention arm assembly 220 is rotated to the first arm position P1 from the second arm position P2, which causes the retention arm assembly 220 to disengage from the deck bushing 124. Disengagement of the retention arm assembly 220 from the deck bushing 124 causes the deck bushing 124 to move to the lowered position, thereby engaging the deck bushing 124 with the retention element 228. The work tool 120 is then removed from the bit basket 142 and replaced with a new work tool. Subsequently, the new work tool is coupled with the drill string 118. Further, it should be noted that, after the inspection and/or the replacement of the work tool 120, the deck bushing 124 is reseated on the mast base plate 125 of the drilling machine 100. Furthermore, the drill string 118 is also lowered to a Ready-To-Drill state or a Ready-To-Tram state.

Figure 5A:
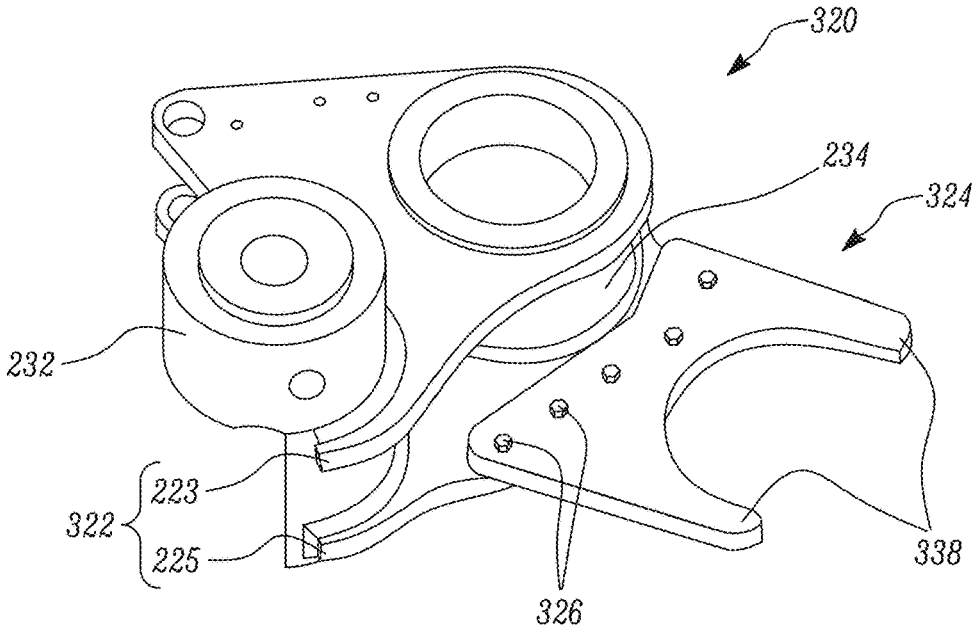
FIG. 5A is a schematic perspective view of a retention arm assembly that may be associated with the retention system of FIGS. 3A to 3D, according to another embodiment of the present disclosure.
Figure 5B:
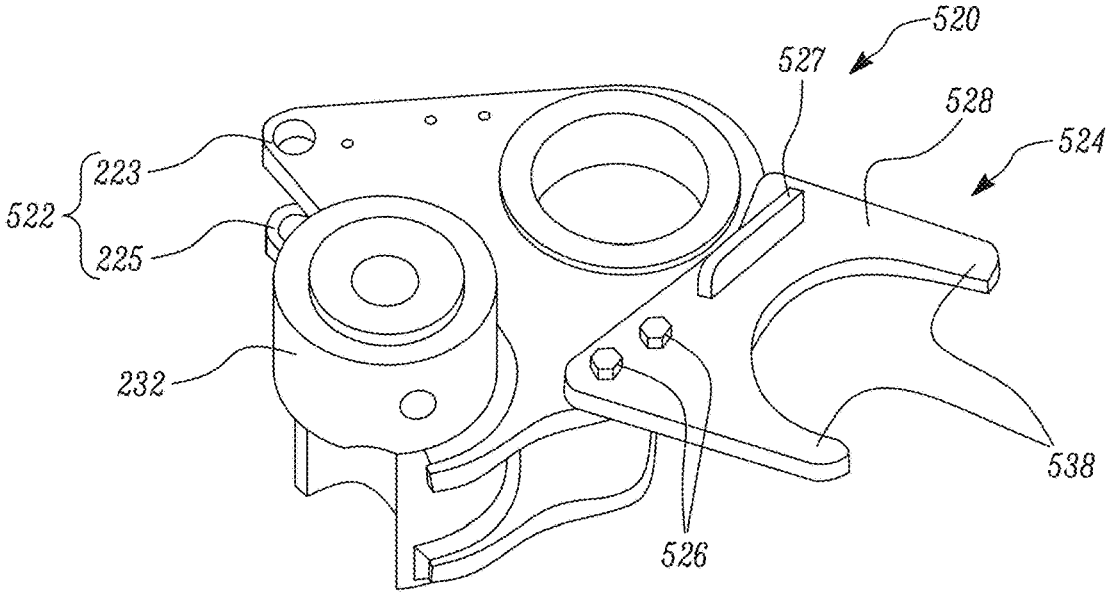
FIG. 5B is a schematic perspective view of a retention arm assembly that may be associated with the retention system of FIGS. 3A to 3D, according to yet another embodiment of the present disclosure.

FIGS. 5A and 5B are schematic perspective views of different designs of retention arm assemblies 320, 520 that may be associated with the retention system 200 of FIGS. 3A to 3D, according to various embodiments of the present disclosure.

As shown in FIG. 5A, the retention arm assembly 320 includes a coupling member 322 and an engaging portion 324. The coupling member 322 is substantially similar to the coupling member 222 (see FIGS. 3A to 3D) of the retention arm assembly 220 (see FIGS. 3A to 3D), with common components referred to by the same numeral. The coupling member 322 is coupled with the first and second coupling units 232, 234 (see FIG. 3D) in a manner similar to the coupling of the coupling member 222 of the retention arm assembly 220 with the first and second coupling units 232, 234. Further, in the illustrated embodiment of FIG. 5A, the engaging portion 324 is not integral with the coupling member 322. Specifically, the engaging portion 324 is removably coupled with the coupling member 322. Alternatively, the engaging portion 324 may be fixedly coupled with the coupling member 322. The retention arm assembly 320 includes a number of mechanical fasteners 326 that removably couple the engaging portion 324 with the coupling member 322. Further, the retention arm assembly 320 is coupled to the second coupling portion 225 of the coupling member 322, such that a portion of the engaging portion 324 is disposed on the second coupling portion 225. The engaging portion 324 includes a pair of arms 338 that form a C-shape. Alternatively, the pair of arms 338 may form a U-shape or an arcuate shape.

As shown in FIG. 5B, the retention arm assembly 520 includes a coupling member 522 and an engaging portion 524. The coupling member 522 is substantially similar to the coupling member 222 (see FIGS. 3A to 3D) of the retention arm assembly 220 (see FIGS. 3A to 3D), with common components referred to by the same numeral. The coupling member 522 is coupled with the first and second coupling units 232, 234 (see FIG. 3D) in a manner similar to the coupling of the coupling member 222 of the retention arm assembly 220 with the first and second coupling units 232, 234. Further, in the illustrated embodiment of FIG. 5B, the engaging portion 524 is not integral with the coupling member 522. Specifically, the engaging portion 524 is removably coupled with the coupling member 522. Alternatively, the engaging portion 524 may be fixedly coupled with the coupling member 522. The retention arm assembly 520 includes a number of mechanical fasteners 526 that removably couple the engaging portion 524 with the coupling member 522. Further, the retention arm assembly 520 is coupled to the first coupling portion 223 of the coupling member 522, such that a portion of the engaging portion 524 is disposed on the first coupling portion 223. The engaging portion 524 includes a pair of arms 538 that form a C-shape. Alternatively, the pair of arms 538 that form a C-shape may form a U-shape or an arcuate shape. Further, the retention arm assembly 520 includes a locking element 527 coupled with the engaging portion 524 of the retention arm assembly 520. Specifically, the locking element 527 is coupled with an upper surface 528 of the engaging portion 524. When the retention arm assembly 520 engages with the deck bushing 124 (see FIG. 2A), the locking element 527 engages with the flange 130 of the deck bushing 124 to prevent a rotation of the deck bushing 124. In other words, when the retention arm assembly 520 engages with the deck bushing 124, the locking element 527 engages with a flat surface (not shown) on the flange 130 of the deck bushing 124 to prevent the rotation of the deck bushing 124 relative to the retention arm assembly 520.

Figure 6:
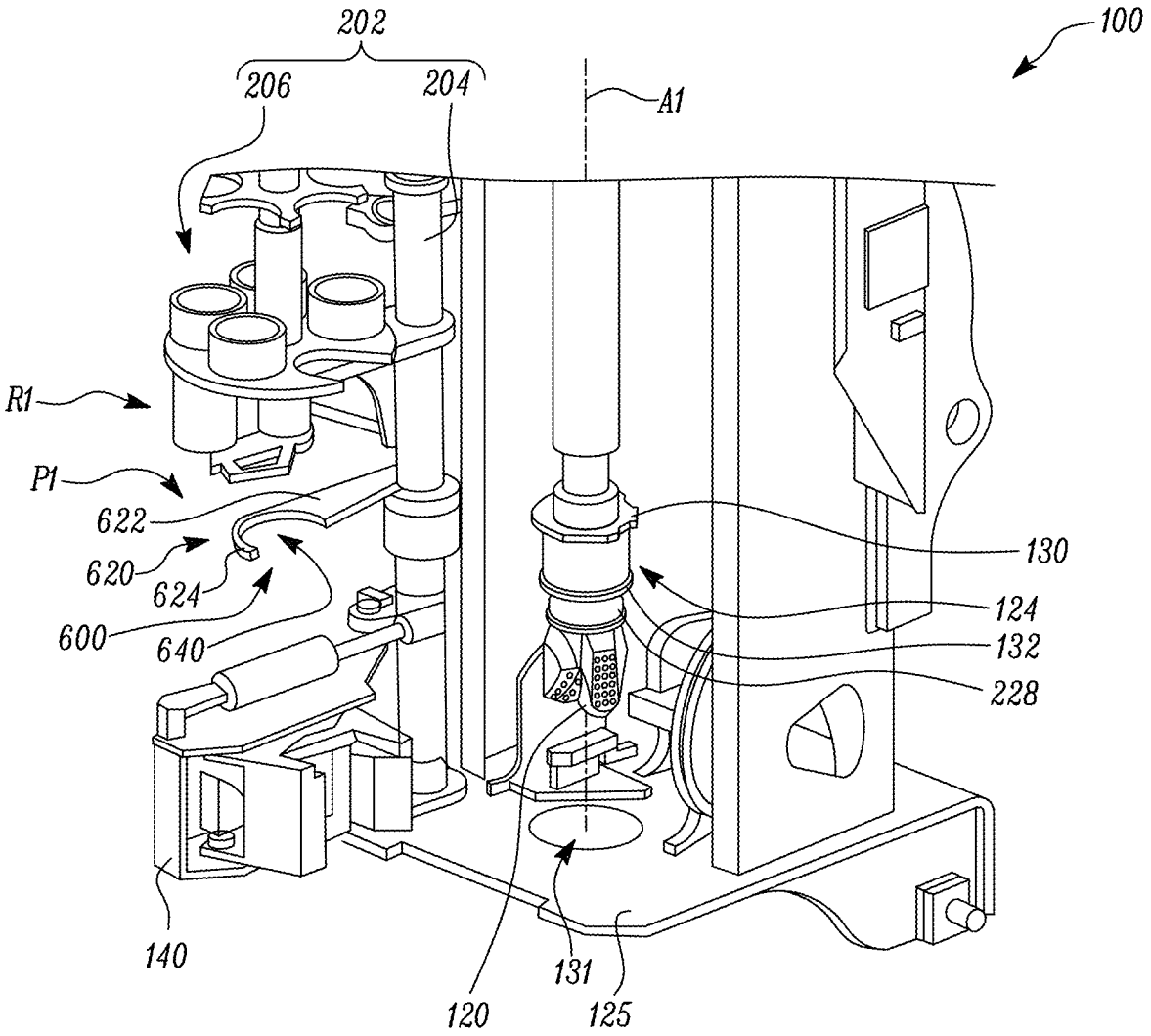
FIG. 6 is a schematic perspective view of a retention system of the drilling machine of FIG. 1 including a retention arm assembly in a first arm position, according to another embodiment of the present disclosure.

Referring now to FIG. 6, a schematic perspective view of a portion of the drilling machine 100 is illustrated. The drilling machine 100 includes a retention system 600, according to another embodiment of the present disclosure. The retention system 600 is substantially similar to the retention system 200 explained in relation to FIGS. 3A to 3D, with common components being referred to by the same numerals. The retention system 600 includes a retention arm assembly 620. In the illustrated embodiment of FIG. 6, the retention arm assembly 620 is removably coupled with the central support 204 of the pipe rack 202. In some examples, the retention arm assembly 620 may be fixedly coupled with the central support 204 of the pipe rack 202. The retention arm assembly 620 is rotatable between the first arm position P1 and the second arm position P2. The retention arm assembly 620 is illustrated in the first arm position P1 in FIG. 6.

The retention arm assembly 620 includes a coupling member 622 that couples the retention arm assembly 620 with the pipe rack 202. Specifically, the coupling member 622 couples the retention arm assembly 620 with the central support 204 of the pipe rack 202. In some examples, the coupling member 622 may be coupled with the central support 204 by fastening means (not shown), such as, bolts, screws, pins, and the like. In other examples, the coupling member 622 may be coupled with the central support 204 by welding, soldering, brazing, and the like. It should be noted that the present disclosure is not limited to a technique of coupling the retention arm assembly 620 with the pipe rack 202. The retention arm assembly 620 also includes an engaging portion 624. The engaging portion 624 defines a C-shape herein. Alternatively, the engaging portion 624 may have an arcuate shape or a U-shape. It should be noted that the retention system 600 also includes a pipe positioner system (not shown herein) that is similar to the pipe positioner system 250 shown in FIGS. 3A and 3B.

Figure 7:
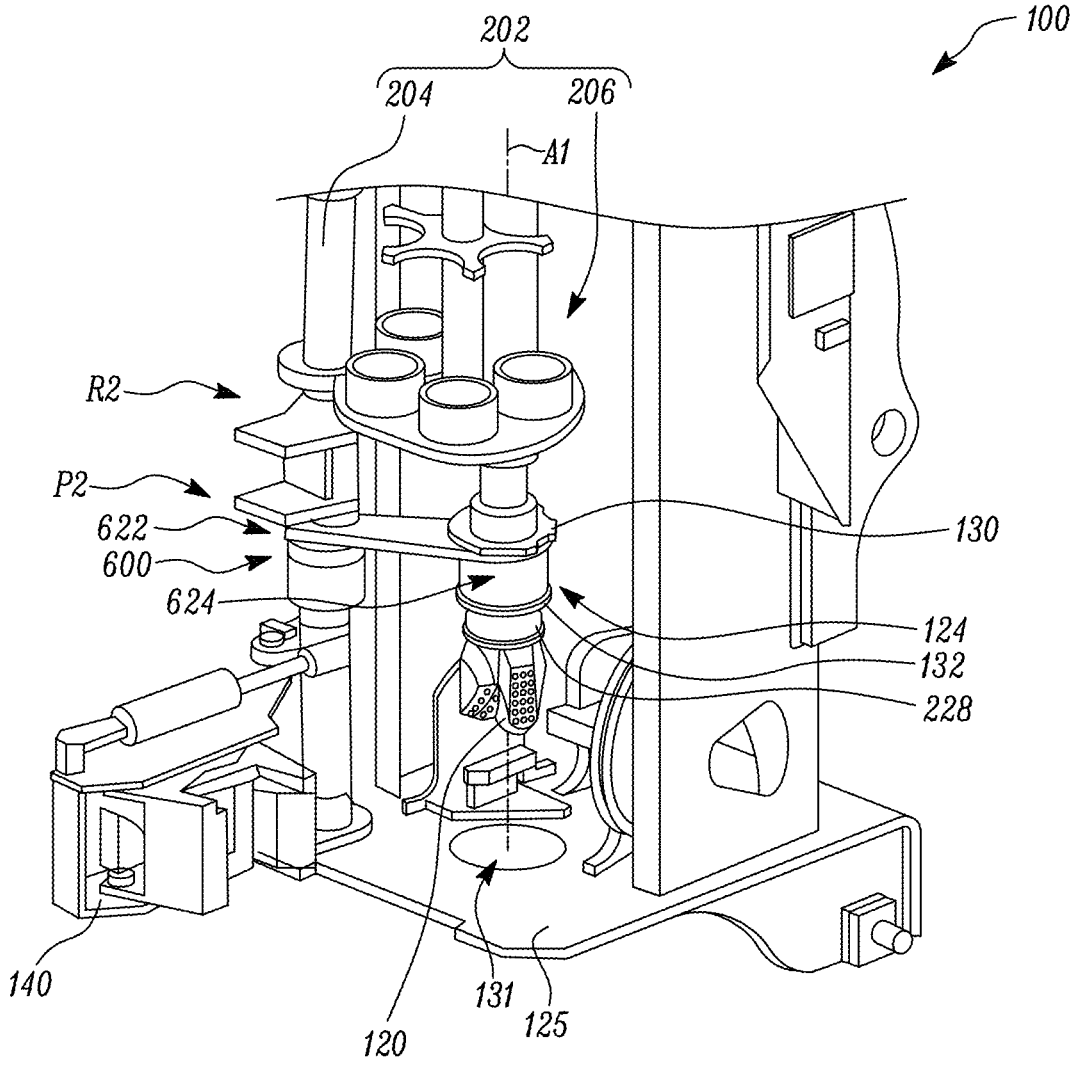
FIG. 7 is a schematic perspective view of the retention arm assembly of FIG. 6 in a second arm position and in engagement with a flange of the deck bushing.

Referring to FIG. 7, a schematic perspective view of the retention system 600 of FIG. 6 is illustrated. The retention arm assembly 620 is shown in the second arm position P2 in FIG. 7. In the second arm position P2, the engaging portion 624 of the retention arm assembly 620 is engaged with the flange 130 of the deck bushing 124. In such examples, a slot 640 (see FIG. 6) defined by the engaging portion 624 receives a portion of the deck bushing 124 therein to engage the retention arm assembly 620 with the flange 130 of the deck bushing 124 to retain the deck bushing 124 in the raised state.

Figure 8:
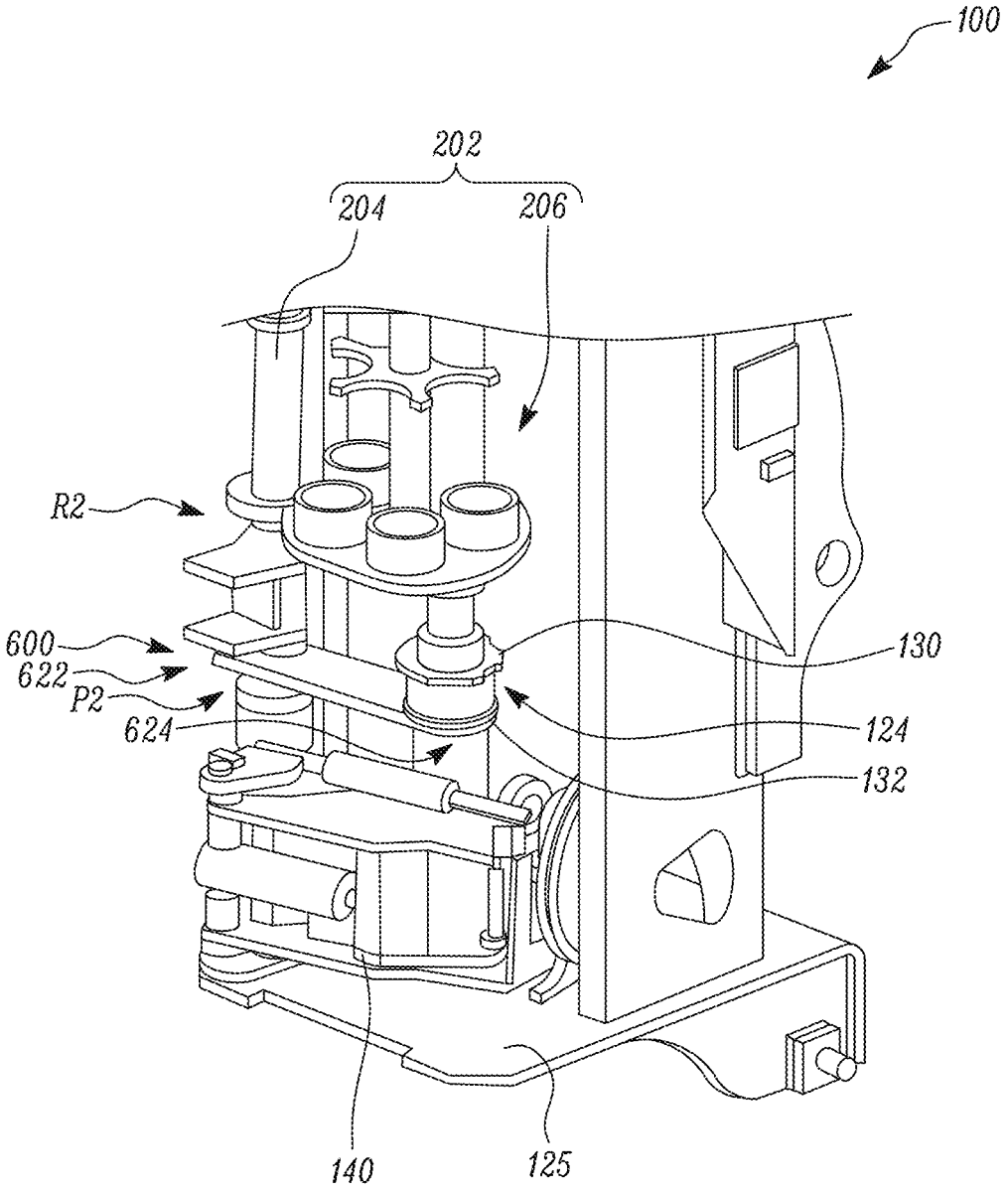
FIG. 8 is a schematic perspective view of the retention arm assembly of FIG. 6 in the second arm position and in engagement with a bottom surface of the deck bushing.

Alternatively, as shown in FIG. 8, the engaging portion 624 of the retention arm assembly 620 of the retention system 600 may engage with the bottom surface 132 of the deck bushing 124. In such examples, the slot 640 (see FIG. 6) defined by the engaging portion 624 receives a portion of the lower sub adaptor 122 therein to engage the retention arm assembly 620 with the bottom surface 132 of the deck bushing 124 to retain the deck bushing 124 in the raised state.

As is apparent from FIG. 6, when the pipe rack 202 is in the first pipe rack position R1 and the retention arm assembly 620 is in the first arm position P1, the retention arm assembly 620 is disengaged from the deck bushing 124. Further, with reference to FIGS. 7 and 8, when the pipe rack 202 is in the second pipe rack position R2 and the retention arm assembly 620 is in the second arm position P2, the retention arm assembly 620 is engaged with the deck bushing 124 to retain the deck bushing 124 in the raised state for disengaging the work tool 120 of the drilling machine 100 from the drill string 118. Specifically, to engage the retention arm assembly 620 with the deck bushing 124, the retention arm assembly 620 is rotated to the second arm position P2 from the first arm position P1 and at the same time the pipe rack 202 is rotated to the second pipe rack position R2 from the first pipe rack position R1. In other words, the retention arm assembly 620 and the pipe rack 202 both rotate along the anticlockwise direction X1 at the same time. The rotation of the retention arm assembly 620 and the pipe rack 202 are caused by the same actuator that rotates the pipe rack 202. Thus, in this embodiment of the retention system 600, the retention arm assembly 620 is not rotatable relative to the pipe rack 202. Accordingly, a requirement of a separate actuator to rotate the retention arm assembly 620 is eliminated.

The retention arm assembly 620 remain engaged till the inspection of the work tool 120 is completed, or the work tool 120 is removed and replaced with the new work tool. After completion of the inspection and/or the replacement of the work tool 120, the drill string 118 is raised up till the deck bushing 124 rides on the work tool 120 once again. Further, when the retention arm assembly 620 is to be disengaged from the deck bushing 124, the pipe rack 202 and the retention arm assembly 620 move to the first pipe rack position R1 and the first arm position P1, respectively, at the same time.

The retention system 600 may also include the retention element 228, 428, 446, 452. It should be noted that the retention system 600 will only include the retention element 228, 428, 446, 452 when the bit basket 142 (see FIG. 4A) is operated automatically. The retention system 600 may not require the retention element 228, 428, 446, 452 when the bit basket 142 is operated manually.

Figure 9:
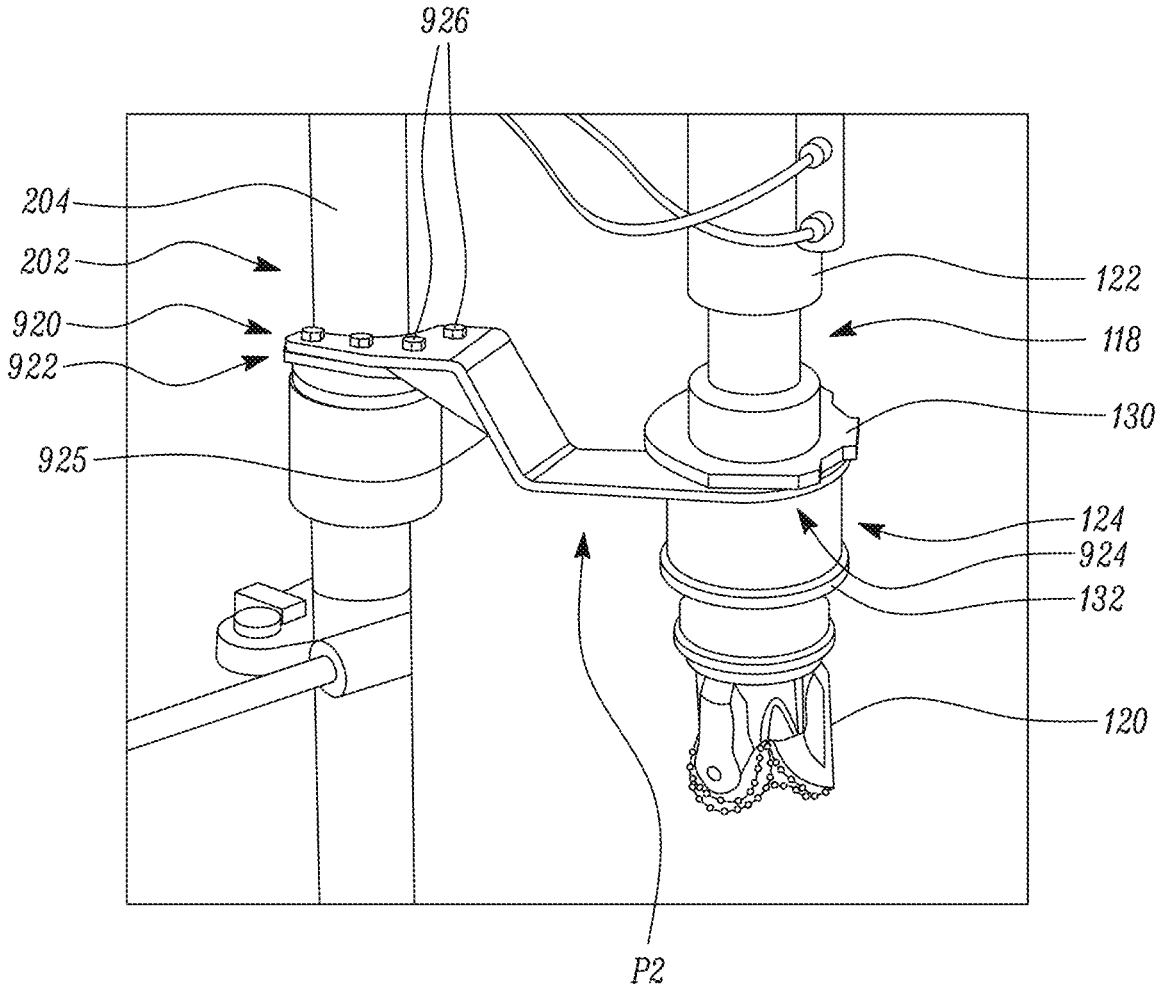
FIG. 9 is a schematic perspective view of a retention arm assembly that may be associated with the retention system of FIG. 6, according to yet another embodiment of the present disclosure.

Referring now to FIG. 9, a schematic perspective view of a portion of the drilling machine 100 is illustrated. The drilling machine 100 includes a retention arm assembly 920 that may be associated with the retention system 600 of FIG. 6, according to another embodiment of the present disclosure. In the illustrated embodiment of FIG. 9, the retention arm assembly 920 is removably coupled with the central support 204 of the pipe rack 202. In some examples, the retention arm assembly 920 may be fixedly coupled with the central support 204 of the pipe rack 202.

The retention arm assembly 920 includes a coupling member 922 that couples the retention arm assembly 920 with the pipe rack 202. Specifically, the coupling member 922 couples the retention arm assembly 920 with the central support 204 of the pipe rack 202. In the illustrated embodiment of FIG. 9, the coupling member 922 is removably coupled with the central support 204 by a number of fastening means 926. The fastening means 926 may include bolts, screws, pins, and the like. In other examples, the coupling member 922 may be fixedly coupled with the central support 204 by welding, soldering, brazing, and the like. It should be noted that the present disclosure is not limited to a technique of coupling the retention arm assembly 920 with the pipe rack 202.

The retention arm assembly 920 also includes an engaging portion 924. The engaging portion 924 defines a C-shape herein. Alternatively, the engaging portion 924 may have an arcuate shape or a U-shape. Further, the retention arm assembly 920 includes an intermediate portion 925 between the coupling member 922 and the engaging portion 924. The intermediate portion 925 angularly extends between the coupling member 922 and the engaging portion 924, such that the coupling member 922 and the engaging portion 924 are offset from each other. The intermediate portion 925, the coupling member 922, and the engaging portion 924 are integral with each other. In an example, the retention arm assembly 920 shown in FIG. 9 may allow one or more components of the drilling machine 100 to be accommodated around the drill string 118 without any interference with the retention arm assembly 920.

The retention arm assembly 920 is rotatable between the first arm position P1 and the second arm position P2. The retention arm assembly 920 is shown in the second arm position P2 in FIG. 9. In the second arm position P2, the engaging portion 924 of the retention arm assembly 920 is engaged with the flange 130 of the deck bushing 124 to retain the deck bushing 124 in the raised state. Alternatively, the engaging portion 924 of the retention arm assembly 920 may engage with the bottom surface 132 of the deck bushing 124 to retain the deck bushing 124 in the raised state.

Figure 10A:
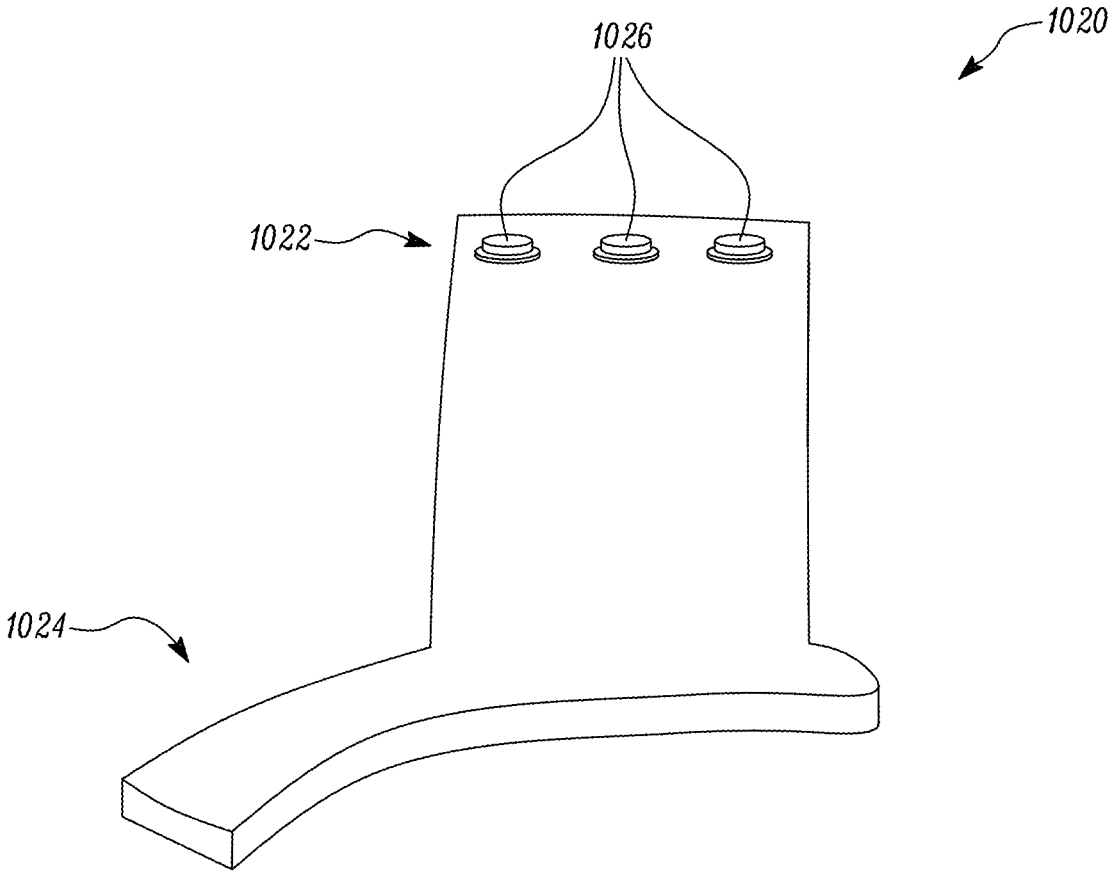
FIG. 10A is a schematic perspective view of a retention arm assembly that may be associated with the retention system of FIG. 6, according to an embodiment of the present disclosure.

Referring now to FIG. 10A, a schematic perspective view of a retention arm assembly 1020 that may be associated with the retention system 600 of FIG. 6 is illustrated, according to another embodiment of the present disclosure. The retention arm assembly 1020 may be removably coupled with the central support 204 (see FIG. 6) of the pipe rack 202 (see FIG. 6). In some examples, the retention arm assembly 1020 may be fixedly coupled with the central support 204 of the pipe rack 202.

The retention arm assembly 1020 includes a coupling member 1022 that couples the retention arm assembly 1020 with the pipe rack 202. Specifically, the coupling member 1022 couples the retention arm assembly 1020 with the central support 204 of the pipe rack 202. The coupling member 1022 may be removably coupled with the central support 204 by fastening means 1026. The fastening means 1026 may include bolts, screws, pins, and the like. In other examples, the coupling member 1022 may be fixedly coupled with the central support 204 by welding, soldering, brazing, and the like. It should be noted that the present disclosure is not limited to a technique of coupling the retention arm assembly 1020 with the pipe rack 202. The retention arm assembly 1020 also includes an engaging portion 1024 that engages with the deck bushing 124 (see FIG. 6). The engaging portion 1024 has an arcuate shape. Alternatively, the engaging portion 1024 may have an arcuate shape or a U-shape.

Figure 10B:
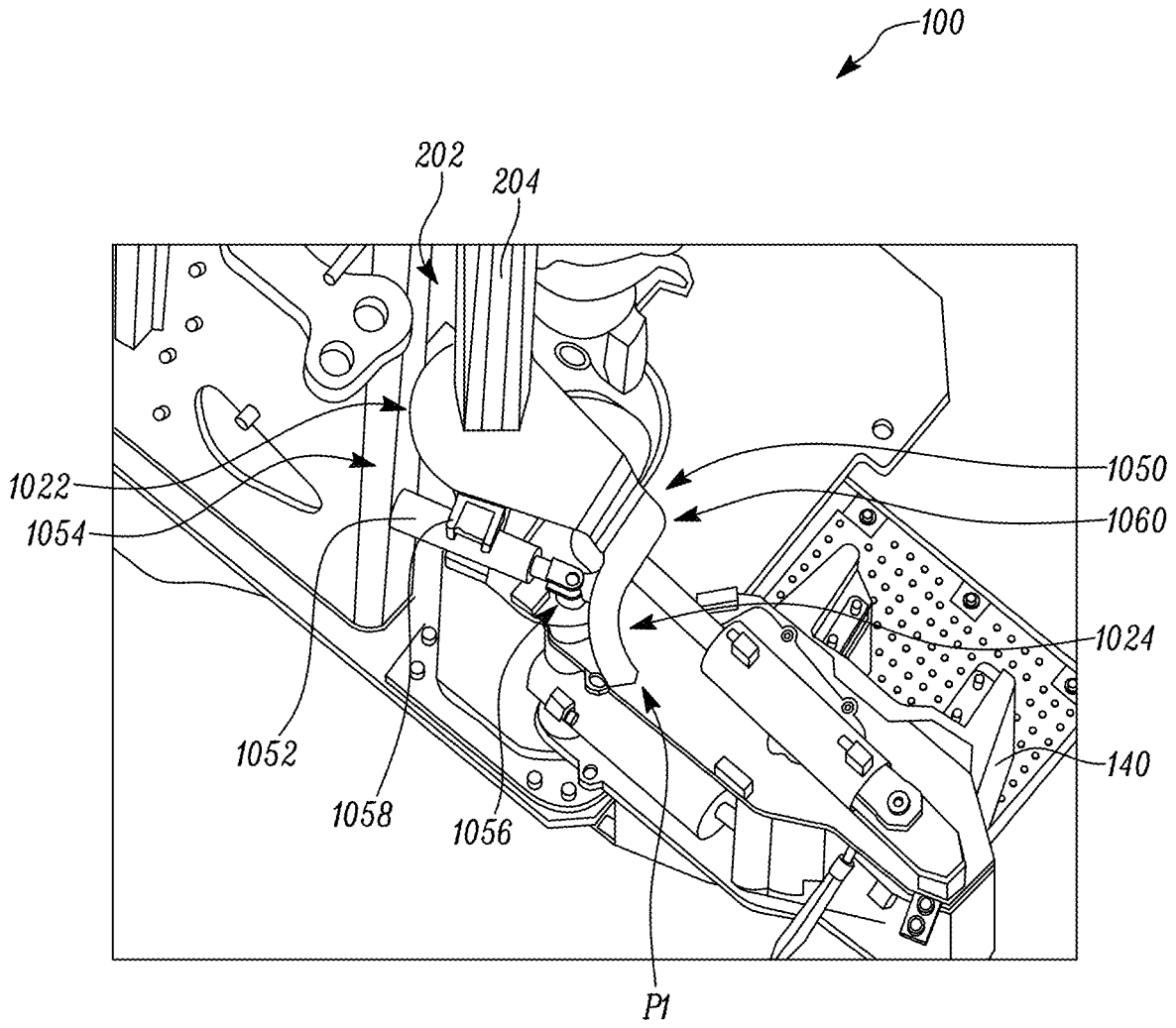
FIG. 10B is a schematic perspective view of a retention system of the drilling machine of FIG. 1 including a retention arm assembly in a first arm position and an actuator in a retracted position, according to another embodiment of the present disclosure.
Figure 10C:
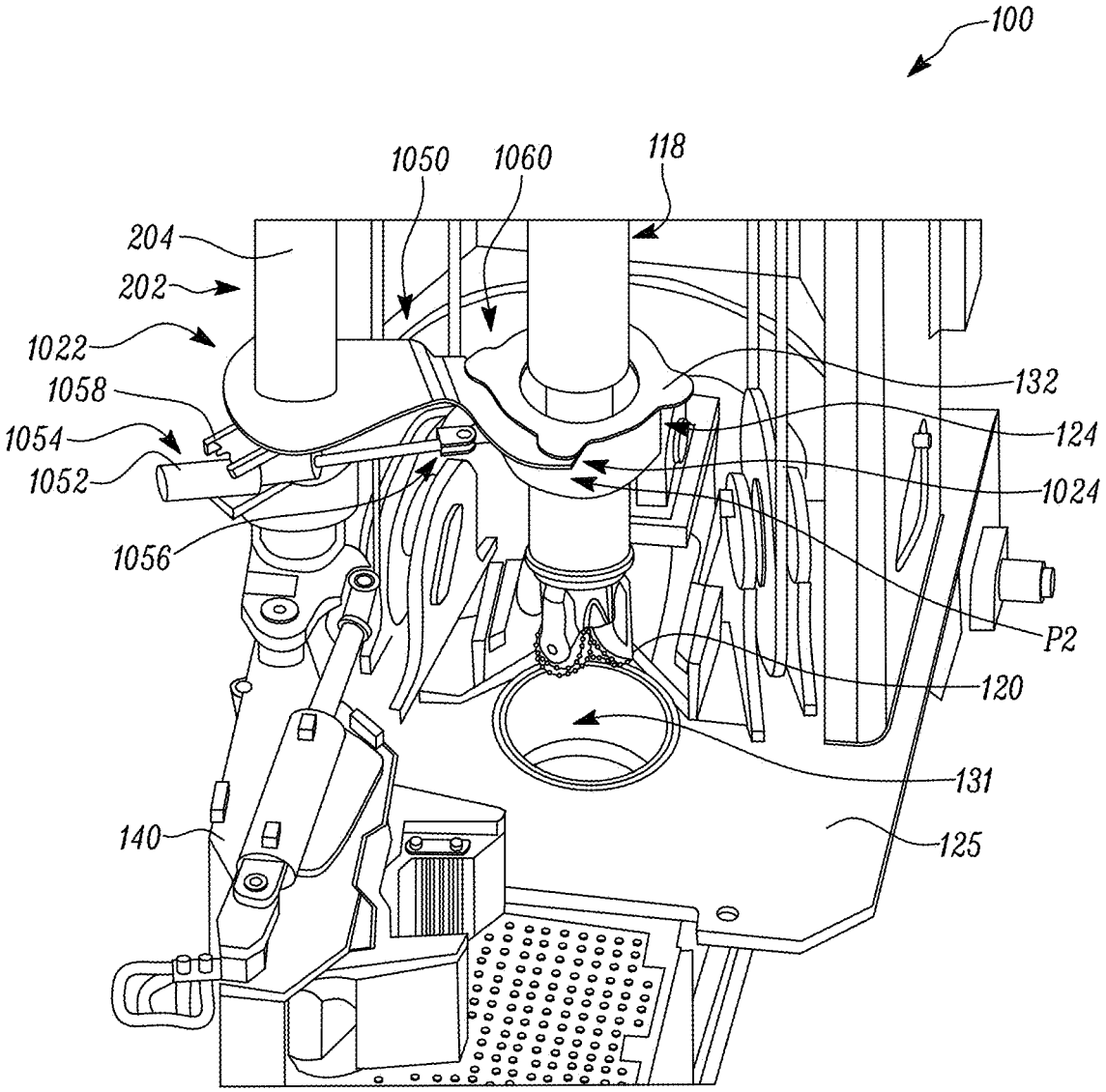
FIG. 10C is a schematic perspective view of the retention arm assembly of FIG. 10B in a second arm position and in engagement with a flange of the deck bushing and the actuator of FIG. 10B in an extended position.

Referring to FIGS. 10B and 10C, schematic perspective views of a portion of the drilling machine 100 is illustrated. The drilling machine 100 includes a retention system 1050, according to another embodiment of the present disclosure. The retention system 1050 is substantially similar to the retention system 200 explained in relation to FIGS. 3A to 3D, with common components being referred to by the same numerals. The retention system 1050 includes a retention arm assembly 1060. The retention arm assembly 1060 is substantially similar to the retention arm assembly 1020 shown in FIG. 10A with common components being referred to by the same numerals. However, the coupling member 1022 of the retention arm assembly 1060 is offset to the engaging portion 1024 the retention arm assembly 1060. Further, the retention arm assembly 1060 is fixedly coupled with the central support 204 by welding, soldering, brazing, and the like. Alternatively, the retention arm assembly 1060 may be removably coupled with the central support 204 of the pipe rack 202.

The retention system 1050 also includes the actuator 1052. The actuator 1052 rotates the retention arm assembly 1060 between the first arm position P1 and the second arm position P2. The retention arm assembly 1060 is illustrated in the first arm position P1 in FIG. 10B and in the second arm position P2 in FIG. 10C. Further, the actuator 1052 moves between an extended position and a retracted position. The actuator 1052 is illustrated in the retracted position in FIG. 10B and in the extended position in FIG. 10C.

One end 1054 of the actuator 1052 is coupled with the pipe rack 202 of the drilling machine 100 and another end 1056 of the actuator 1052 is coupled with the retention arm assembly 1060. Specifically, the end 1054 is coupled with the pipe rack 202 via a bracket 1058.

When the actuator 1052 moves to the extended position, the actuator 1052 causes the retention arm assembly 1060 to rotate relative to the carousel 206 (see FIG. 6) thereby moving the retention arm assembly 1060 from the first arm position P1 to the second arm position P2. Further, when the actuator 1052 moves to the retracted position, the actuator 1052 causes the retention arm assembly 1060 to rotate from the second arm position P2 to the first arm position P1.

Figure 11:
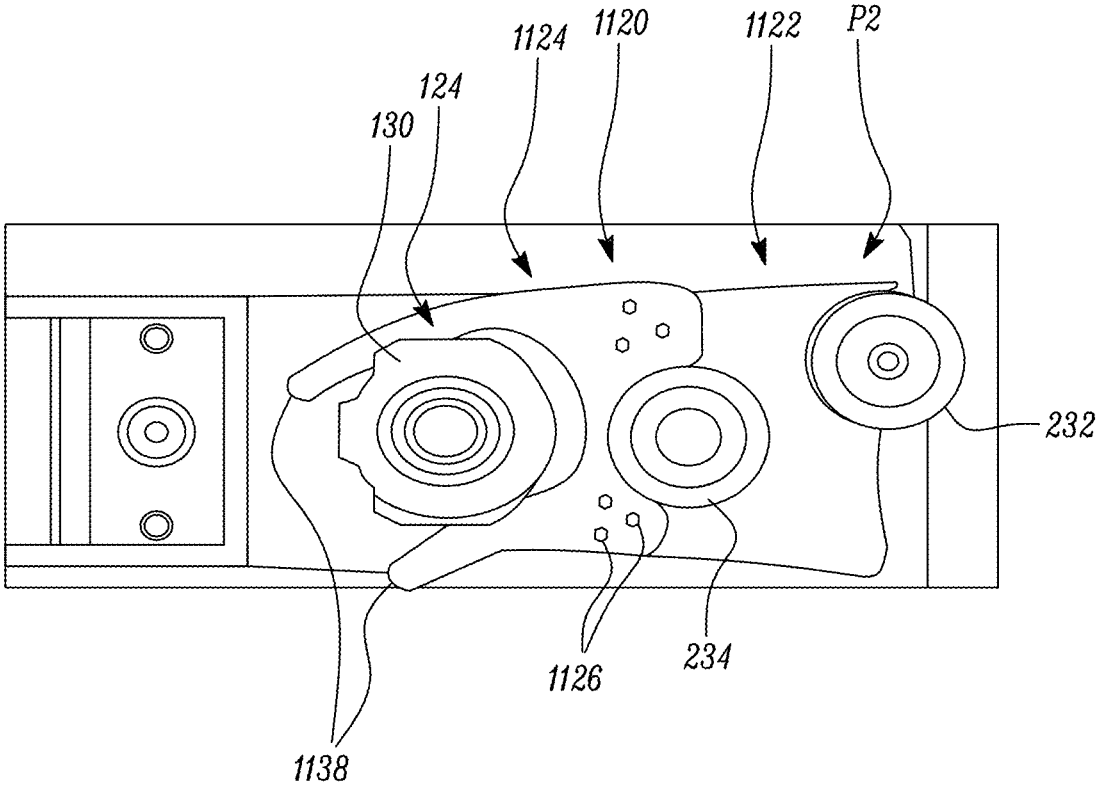
FIG. 11 is a schematic perspective view of a retention arm assembly that may be associated with the retention system of FIGS. 3A to 3D, according to yet another embodiment of the present disclosure.

Referring now to FIG. 11, a schematic perspective view of a retention arm assembly 1120 that may be associated with the retention system 200 of FIGS. 3A to 3D is illustrated, according to another embodiment of the present disclosure. The retention arm assembly 1120 may be fixedly or removably coupled with the carousel 206 (see FIG. 3A) of the pipe rack 202 (see FIG. 3A).

The retention arm assembly 1120 includes a coupling member 1122 that couples the retention arm assembly 1120 with the pipe rack 202. Specifically, the coupling member 1122 couples the retention arm assembly 1120 with the carousel 206 of the pipe rack 202. In the illustrated embodiment of FIG. 11, the coupling member 1122 is removably coupled with the second coupling unit 234 by fastening means (not shown herein). The fastening means may include bolts, screws, pins, and the like. In other examples, the coupling member 1122 may be coupled with the second coupling unit 234 by welding, soldering, brazing, and the like. It should be noted that the present disclosure is not limited to a technique of coupling the retention arm assembly 1120 with the pipe rack 202.

The retention arm assembly 1120 also includes an engaging portion 1124. The engaging portion 1124 includes a pair of arms 1138 that define a U-shape. Alternatively, the engaging portion 1124 may have an arcuate shape or a C-shape. Further, the coupling member 1122 and the engaging portion 1124 are removably coupled with each other using mechanical fasteners 1126. The mechanical fasteners 1126 may include bolts, pins, screws, and the like. A portion of the engaging portion 1124 is disposed on the coupling member 1122 such that the coupling member 1122 is removably coupled with the engaging portion 1124 using the mechanical fasteners 1126. Alternatively, the coupling member 1122 and the engaging portion 1124 may be fixedly coupled with each other.

The retention arm assembly 1120 is rotatable between the first arm position P1 and the second arm position P2. The retention arm assembly 1120 is illustrated in the second arm position P2 in FIG. 11. In the second arm position P2, the engaging portion 1124 of the retention arm assembly 1120 is engaged with the flange 130 of the deck bushing 124 to retain the deck bushing 124 in the raised state. Alternatively, the engaging portion 1124 of the retention arm assembly 1120 may engage with the bottom surface 132 (see FIG. 2A) of the deck bushing 124 to retain the deck bushing 124 in the raised state.

It is to be understood that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the retention system 200, 600, 1050 for the drilling machine 100. The present disclosure relates to automatic retention of the deck bushing 124 using the retention system 200, 600, 1050 for enabling removal/replacement of the work tool 120, 121 and/or the hammer 123. The retention system 200, 600, 1050 may be used with both manual and autonomous drilling machines. The retention system 200, 600, 1050 may be used during above-the-deck removal/breaking of the work tools 120, 121, or the hammer 123.

The retention system 200, 600, 1050 includes the retention arm assembly 220, 320, 520, 620, 920, 1020, 1060, 1120 coupled with the pipe rack 202. Further, the retention arm assembly 220, 320, 520, 620, 920, 1020, 1060, 1120 including the coupling member 222, 322, 522, 622, 922, 1022, 1122, the pipe rack 202, the pipe positioner system 250, and the retention element 228, 428, 446, 452 is coupled proximal to the bottom end 134 of the drill string 118. In an example, the retention arm assembly 220, 320, 520, 620, 920, 1020, 1060, 1120 is fixedly or removably coupled to the central support 204 or the carousel 206. The removably coupled retention arm assembly 220, 320, 520, 620, 920, 1020, 1120 may be a bolt-on joint that may address manufacturing tolerance related fit up and functional issues by provision of oversized holes, slots, or any other feature.

The retention arm assembly 220, 320, 520, 620, 920, 1020, 1060, 1120 automatically holds and secures the deck bushing 124 on the drill string 118, thereby preventing the deck bushing 124 from slipping during the removal/replacement of worn-out work tools or hammers. The retention system 200, 600, 1050 makes use of the pipe rack 202 that already exists on drilling machines to assist in retention of the deck bushing 124. Thus, the pipe rack 202 performs the dual purpose of loading or unloading of the drill strings and/or the drill pipes as well as assists in retention of the deck bushing 124. In other words, the pipe rack 202 may be a multi-functional pipe rack that, along with an existing primary function of storing the drill pipes, also allows adding the drill pipes to the drill string 118 in a multi-pass drilling operation.

The retention arm assembly 220, 320, 520, 620, 920, 1020, 1060, 1120 and the retention element 228, 428, 446, 452 have a simple design and are therefore cost-effective to manufacture and install. In some examples, the drilling machine 100 may include a programming software to control a sequence of all the operations involved and all other integrating systems associated with the drilling machine 100. Further, the retention system 200, 600, 1050 is simple to operate and requires minimal operator involvement for holding the deck bushing 124, which may reduce operator fatigue, eliminates live work, and may improve a productivity of the operator. The retention system 200, 600, 1050 allows easy handling of various components of the drilling machine 100 during removal/replacement of heavy work tools or hammers.

The retention system 200, 600, 1050 along with the bit basket 142, the pipe positioner system 250, a lifting bail of the drilling machine 100, and a mast winch system of the drilling machine 100 may improve a level of safety as well as completely eliminate live work for operators. The pipe positioner system 250 guides and centers the movement of the drill string 118 along the vertical axis A1 when the retention arm assembly 220, 320, 520, 620, 920, 1020, 1060, 1120 engages with the deck bushing 124. The pipe positioner system 250 may prevent any undesired movement or shaking of the drill string 118, thereby improving retention performance of the retention system 200, 600, 1050 to retain the deck bushing 124. In an example, the pipe positioner system 250 may support the drill string 118 even when the drill pipe 119 is worn resulting in proper retention of the deck bushing 124. Further, the pipe positioner system 250 may prevent interference of the retention arm assembly 220, 320, 520, 620, 920, 1020, 1060, 1120 with one or more components of the drilling machine 100 that may result in effective retention of the deck bushing 124. In other words, the engagement of the pipe positioner system 250 with the drill string 118 may minimize an interference of the retention arm assembly 220, 320, 520, 620, 920, 1020, 1060, 1120 with the drill string 118 and may prevent damage to the retention arm assembly 220, 320, 520, 620, 920, 1020, 1060, 1120.

The retention system 200, 600, 1050 reduces operator efforts that may be otherwise spent on manually coupling and removing conventional horseshoe tools with the deck bushing 124. Moreover, the retention system 200, 600, 1050 described herein may also reduce time required for removal/replacement of work tools or hammers. Further, the retention system 200, 600, 1050 may improve an operating time and an efficiency of the drilling machine 100 by reducing time required for removal/replacement of work tools and hammers. Furthermore, the retention system 200, 600, 1050 may be implemented on existing drilling machines.

Figure 12:
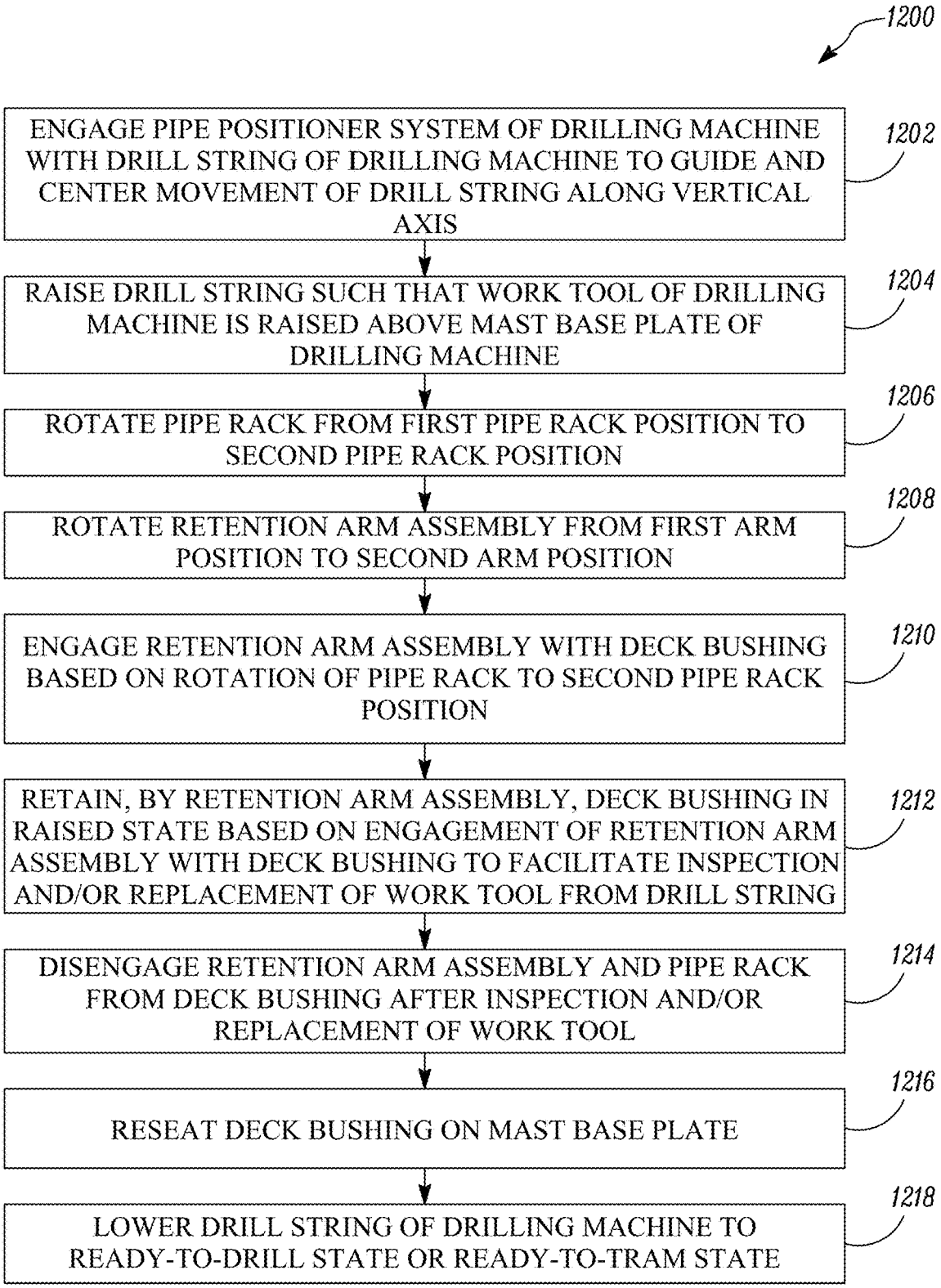
FIG. 12 is a flowchart of a method for retaining the deck bushing of the drilling machine of FIG. 1, according to an embodiment of the present disclosure.

Referring to FIG. 12, a flowchart of a method 1200 for retaining the deck bushing 124 of the drilling machine 100 is illustrated. The deck bushing 124 is movable relative to the drill string 118 of the drilling machine 100. With reference to FIGS. 1 to 12, at step 1202, the pipe positioner system 250 is engaged with the drill string 118 to guide and center the movement of the drill string 118 along the vertical axis A1. The pipe positioner system 250 includes the one or more support arms 252, 254 that contacts with the drill string 118 to facilitate the movement of the drill string 118 along the vertical axis A1.

At step 1204, the drill string 118 is raised such that the work tool 120, 121 of the drilling machine 100 is raised above the mast base plate 125 of the drilling machine 100. At step 1206, the pipe rack 202 is rotated from the first pipe rack position R1 to the second pipe rack position R2.

At step 1208, the retention arm assembly 220, 320, 520, 620, 920, 1020, 1060, 1120 is rotated from the first arm position P1 to the second arm position P2. The retention arm assembly 220, 320, 520, 620, 920, 1020, 1060, 1120 is coupled with the pipe rack 202 of the drilling machine 100. When the retention arm assembly 220, 320, 520, 620, 920, 1020, 1060, 1120 is in the first arm position P1, the retention arm assembly 220, 320, 520, 620, 920, 1020, 1060, 1120 is disengaged from the deck bushing 124.

At step 1210, the retention arm assembly 220, 320, 520, 620, 920, 1020, 1060, 1120 is engaged with the deck bushing 124 based on the rotation of the pipe rack 202 to the second pipe rack position R2. The deck bushing 124 defines the upper end 126 and the lower end 128 opposite the upper end 126. The deck bushing 124 includes the flange 130 defined at the upper end 126 and the bottom surface 132 defined at the lower end 128. The step 1210 further includes engaging the retention arm assembly 220, 320, 520, 620, 920, 1020, 1060, 1120 with the flange 130 of the deck bushing 124 or the bottom surface 132 of the deck bushing 124.

At step 1212, the deck bushing 124 is retained by the retention arm assembly 220, 320, 520, 620, 920, 1020, 1060, 1120 in the raised state based on the engagement of the retention arm assembly 220, 320, 520, 620, 920, 1020, 1060, 1120 with the deck bushing 124 to facilitate the inspection and/or the replacement of the work tool 120, 121 from the drill string 118.

At step 1214, the retention arm assembly 220, 320, 520, 620, 920, 1020, 1060, 1120 is disengaged from the deck bushing 124 after the inspection and/or the replacement of the work tool 120, 121.

At step 1216, the deck bushing 124 reseats on the mast base plate 125. At step 1218, the drill string 118 of the drilling machine 100 is lowered to the Ready-To-Drill state or the Ready-To-Tram state.

The method 1200 includes a step (not shown) at which the retention arm assembly 220, 320, 520, 620, 920, 1020, 1060, 1120 is rotated from the second arm position P2 to the first arm position P1. The method 1200 also includes a step (not shown) at which the pipe rack 202 is rotated from the second pipe rack position R2 to the first pipe rack position R1. The method 1200 further includes a step (not shown) at which the deck bushing 124 is engaged with the retention element 228, 428, 446, 452 based on the rotation of the pipe rack 202 from the second pipe rack position R2 to the first pipe rack position R1 and the rotation of the retention arm assembly 220, 320, 520, 620, 920, 1020, 1060, 1120 from the second arm position P2 to the first arm position P1. The retention element 228, 428, 446, 452 is coupled proximal to the bottom end 134 of the drill string 118. The method 1200 includes a step (not shown) at which the deck bushing 124 is retained by the retention element 228, 428, 446, 452 on the drill string 118 based on an engagement of the deck bushing 124 with the retention element 228, 428, 446, 452.

It should be noted that the steps 1202, 1204, 1206, 1208, 1210, 1212, 1214, 1216, 1218 of the method 1200 may be performed in a sequence that is different from that explained in relation to FIG. 12. Further, various steps 1202, 1204, 1206, 1208, 1210, 1212, 1214, 1216, 1218 can be performed together.

While aspects of the present disclosure have been particularly shown and described with reference to the embodiments above, it will be understood by those skilled in the art that various additional embodiments may be contemplated by the modification of the disclosed work machine, systems, and methods without departing from the spirit and scope of the disclosure. Such embodiments should be understood to fall within the scope of the present disclosure as determined based upon the claims and any equivalents thereof.

What is claimed is:

1. A retention system for retaining a deck bushing of a drilling machine, the deck bushing is movable relative to a drill string of the drilling machine, the retention system comprising:

a pipe rack rotatable between a first pipe rack position and a second pipe rack position;

a retention arm assembly coupled with the pipe rack, wherein the retention arm assembly is rotatable relative to the pipe rack between a first arm position and a second arm position, the retention arm assembly includes a coupling member that couples the retention arm assembly with the pipe rack and an engaging portion coupled with the coupling member, wherein, when the pipe rack is in the first pipe rack position and the retention arm assembly is in the first arm position, the engaging portion of the retention arm assembly is disengaged from the deck bushing, and wherein, when the pipe rack is in the second pipe rack position and the retention arm assembly is in the second arm position, the engaging portion of the retention arm assembly is engaged with the deck bushing to retain the deck bushing in a raised state to facilitate an inspection and/or a replacement of a work tool from the drill string of the drilling machine; and a pipe positioner system that contacts the drill string to guide and center a movement of the drill string along a vertical axis before the retention arm assembly engages with the deck bushing, wherein the pipe positioner system includes at least one support arm that contacts with the drill string to facilitate the movement of the drill string along the vertical axis.

2. The retention system of claim 1, wherein, to engage the retention arm assembly with the deck bushing, the retention arm assembly is rotated to the second arm position from the first arm position followed by a rotation of the pipe rack to the second pipe rack position from the first pipe rack position.

3. The retention system of claim 1 further comprising an actuator adapted to rotate the retention arm assembly between the first arm position and the second arm position, wherein one end of the actuator is coupled with the pipe rack of the drilling machine and another end of the actuator is coupled with the retention arm assembly.

4. The retention system of claim 1, wherein the retention arm assembly further includes a locking element coupled with the engaging portion of the retention arm assembly, and wherein, when the retention arm assembly engages with the deck bushing, the locking element engages with a flange of the deck bushing to prevent a rotation of the deck bushing.

5. The retention system of claim 1 further comprising one or more fastening members that removably couple the coupling member of the retention arm assembly with the pipe rack.

6. The retention system of claim 1, wherein the deck bushing defines an upper end and a lower end opposite the upper end, wherein the deck bushing includes a flange defined at the upper end and a bottom surface defined at the lower end, and wherein, when the pipe rack is in the second pipe rack position and the retention arm assembly is in the second arm position, the engaging portion is engaged with the flange of the deck bushing or a bottom surface of the deck bushing.

7. The retention system of claim 1 further comprising a retention element coupled proximal to a bottom end of the drill string, wherein, when the pipe rack is rotated to the first pipe rack position from the second pipe rack position and the retention arm assembly is rotated to the first arm position from the second arm position, the retention element is engaged with the deck bushing to retain the deck bushing on the drill string.

8. The retention system of claim 7, wherein the retention element defines a maximum diameter that is greater than an inner diameter of the deck bushing.

9. The retention system of claim 1, wherein the at least one support arm includes a first support arm and a second support arm, wherein the pipe positioner system further includes a first actuator associated with the first support arm and a second actuator associated with the second support arm, wherein, based on an extension of the first actuator, the first support arm contacts with the drill string, and wherein, based on an extension of the second actuator, the second support arm contacts with the drill string.

10. The retention system of claim 1, wherein the pipe rack includes a central support and a carousel coupled to the central support, and wherein the retention arm assembly is removably coupled to the central support or the carousel.

11. A drilling machine comprising:

a frame;

a mast system supported on the frame;

a mast weldment coupled to the frame;

a drill string;

a work tool coupled to the drill string;

a deck bushing movable relative to the drill string; and a retention system for retaining the deck bushing in a raised state to facilitate an inspection and/or a replacement of the work tool from the drill string of the drilling machine, the retention system including:

a pipe rack coupled to the mast weldment, wherein the pipe rack is rotatable between a first pipe rack position and a second pipe rack position;

a retention arm assembly coupled with the pipe rack, the retention arm assembly including a retention element coupled proximal to a bottom end of the drill string, wherein the retention element defines a maximum diameter that is greater than an inner diameter of the deck bushing:

wherein the retention arm assembly is rotatable relative to the pipe rack between a first arm position and a second arm position, wherein, when the pipe rack is in the first pipe rack position and the retention arm assembly is in the first arm position, the retention arm assembly is disengaged from the deck bushing, and wherein, when the pipe rack is in the second pipe rack position and the retention arm assembly is in the second arm position, the retention arm assembly is engaged with the deck bushing to retain the deck bushing in the raised state to facilitate the inspection and/or the replacement of the work tool from the drill string of the drilling machine;

wherein, when the pipe rack is rotated to the first pipe rack position from the second pipe rack position and the retention arm assembly is rotated to the first arm position from the second arm position, the retention element is engaged with the deck bushing to retain the deck bushing on the drill string; and a pipe positioner system coupled to the mast weldment, wherein the pipe positioner system contacts the drill string to guide and center a movement of the drill string along a vertical axis before the retention arm assembly engages with the deck bushing, and wherein the pipe positioner system includes at least one support arm that contacts with the drill string to facilitate the movement of the drill string along the vertical axis.

12. The drilling machine of claim 11, wherein, to engage the retention arm assembly with the deck bushing, the retention arm assembly is rotated to the second arm position from the first arm position followed by a rotation of the pipe rack to the second pipe rack position from the first pipe rack position.

13. The drilling machine of claim 11, wherein the retention arm assembly includes:

a coupling member that couples the retention arm assembly with the pipe rack; and an engaging portion coupled with the coupling member, wherein, when the pipe rack is in the second pipe rack position and the retention arm assembly is in the second arm position, the engaging portion engages with the deck bushing.

14. The drilling machine of claim 13, wherein the retention system further includes one or more fastening members that removably couple the coupling member of the retention arm assembly with the pipe rack.

15. The drilling machine of claim 13, wherein the deck bushing defines a upper end and a lower end opposite the upper end, wherein the deck bushing includes a flange defined at the upper end and a bottom surface defined at the lower end, and wherein, when the retention arm assembly is in the second arm position, the engaging portion is engaged with the flange of the deck bushing or a bottom surface of the deck bushing.

16. A method for retaining a deck bushing of a drilling machine, the deck bushing is movable relative to a drill string of the drilling machine, the method comprising:

engaging a pipe positioner system of the drilling machine with the drill string of the drilling machine to guide and center a movement of the drill string along a vertical axis, wherein the pipe positioner system includes at least one support arm that contacts with the drill string to facilitate the movement of the drill string along the vertical axis;

raising the drill string such that a work tool of the drilling machine is raised above a mast base plate of the drilling machine;

rotating a pipe rack from a first pipe rack position to a second pipe rack position;

rotating a retention arm assembly from a first arm position to a second arm position, wherein the retention arm assembly is coupled with the pipe rack of the drilling machine, and wherein, when the retention arm assembly is in the first arm position, the retention arm assembly is disengaged from the deck bushing, wherein the deck bushing defines a upper end and a lower end opposite the upper end, wherein the deck bushing includes a flange defined at the upper end and a bottom surface defined at the lower end;

engaging the retention arm assembly with the flange of the deck bushing or the bottom surface of the deck bushing based on the rotation of the pipe rack to the second pipe rack position;

retaining, by the retention arm assembly, the deck bushing in a raised state based on an engagement of the retention arm assembly with the deck bushing to facilitate an inspection and/or a replacement of the work tool from the drill string;

disengaging the retention arm assembly and the pipe rack from the deck bushing after the inspection and/or the replacement of the work tool;

reseating the deck bushing on the mast base plate; and lowering the drill string of the drilling machine to a Ready-To-Drill state or a Ready-To-Tram state.

17. The method of claim 16 further comprising:

rotating the retention arm assembly from the second arm position to the first arm position;

rotating the pipe rack from the second pipe rack position to the first pipe rack position;

engaging the deck bushing with a retention element based on the rotation of the pipe rack from the second pipe rack position to the first pipe rack position and the rotation of the retention arm assembly from the second arm position to the first arm position, wherein the retention element is coupled proximal to a bottom end of the drill string; and retaining, by the retention element, the deck bushing on the drill string based on an engagement of the deck bushing with the retention element.

* * * * *